US008732890B2

(12) United States Patent
Mohr et al.

(10) Patent No.: US 8,732,890 B2
(45) Date of Patent: May 27, 2014

(54) TOOTHBRUSH

(75) Inventors: Juergen Mohr, Idstein (DE); Martin Vitt, Frankfurt (DE); Jens Stoerkel, Kronberg (DE)

(73) Assignee: Braun GmbH, Kronberg (DE)

( * ) Notice: Subject to any disclaimer, the term of this patent is extended or adjusted under 35 U.S.C. 154(b) by 189 days.

(21) Appl. No.: 13/300,932

(22) Filed: Nov. 21, 2011

(65) Prior Publication Data

US 2012/0174330 A1 Jul. 12, 2012

Related U.S. Application Data

(60) Provisional application No. 61/416,112, filed on Nov. 22, 2010.

(51) Int. Cl.
*A46B 9/04* (2006.01)

(52) U.S. Cl.
USPC ..... 15/167.1; 15/143.1

(58) Field of Classification Search
USPC ..... 15/167.1, 22.1, 22.2, 143.1
See application file for complete search history.

(56) References Cited

U.S. PATENT DOCUMENTS

| | | | | |
|---|---|---|---|---|
| 4,802,255 | A | 2/1989 | Breuer et al. | |
| 5,268,005 | A | 12/1993 | Suhonen | |
| 5,313,909 | A | 5/1994 | Tseng et al. | |
| 5,630,244 | A | 5/1997 | Chang | |
| 5,722,106 | A | 3/1998 | Masterman et al. | |
| 5,836,769 | A | 11/1998 | Spencer | |
| 5,980,542 | A | 11/1999 | Saldivar | |
| 6,006,126 | A | 12/1999 | Cosman | |
| 6,018,840 | A | 2/2000 | Guay et al. | |
| 6,058,541 | A | 5/2000 | Masterman et al. | |
| 6,102,923 | A | 8/2000 | Murayama | |
| 6,151,745 | A | 11/2000 | Roberts et al. | |
| 6,199,242 | B1 | 3/2001 | Masterman et al. | |
| 6,402,768 | B1 | 6/2002 | Liebel | |
| 6,475,553 | B2 | 11/2002 | Guay et al. | |
| 6,553,604 | B1 | 4/2003 | Braun et al. | |
| 6,786,732 | B2 | 9/2004 | Savill et al. | |
| 7,383,619 | B2 * | 6/2008 | Gross et al. | 16/430 |

(Continued)

FOREIGN PATENT DOCUMENTS

| | | |
|---|---|---|
| WO | WO2007084847 | 6/2007 |
| WO | WO2007084647 | 7/2007 |
| WO | WO2007084727 | 7/2007 |
| WO | WO2007084768 | 7/2007 |

OTHER PUBLICATIONS

International Search Report and written opinion, date mailed Feb. 10, 2012, 11 pages.

*Primary Examiner* — Shay Karls
(74) *Attorney, Agent, or Firm* — George Henry Leal; James Ernest Oehlenschlager; Vladimir Vitenberg

(57) ABSTRACT

An oral care implement is described herein. The oral care implement has a base having a handle region, an oral engaging region and a neck between the handle region and the oral engaging region. A recess surrounds the handle and/or the neck and has a first boundary and a second boundary, and the first boundary is further from a distal end than the second boundary. The first boundary has an angle of greater than about 90 degrees with respect to a mold parting line of the oral care implement. The base has a first material, and a collar made of a second material which is different than the first material, is disposed in the recess.

17 Claims, 19 Drawing Sheets

(56) References Cited

U.S. PATENT DOCUMENTS

| | | | |
|---|---|---|---|
| 2002/0138931 | A1 | 10/2002 | Davies |
| 2003/0084527 | A1 | 5/2003 | Brown et al. |
| 2003/0162145 | A1 | 8/2003 | Masterman et al. |
| 2004/0025272 | A1 | 2/2004 | Stvartak |
| 2004/0134007 | A1 | 7/2004 | Davies |
| 2004/0154112 | A1 | 8/2004 | Braun et al. |
| 2004/0255416 | A1 | 12/2004 | Hohlbein |
| 2005/0000043 | A1 | 1/2005 | Chan et al. |
| 2005/0000049 | A1 | 1/2005 | Hohlbein |
| 2005/0038461 | A1 | 2/2005 | Phillips |
| 2005/0166344 | A1 | 8/2005 | Hohlbein et al. |
| 2005/0210612 | A1 | 9/2005 | Hohlbein et al. |
| 2006/0010628 | A1 | 1/2006 | Moskovich |
| 2006/0026784 | A1 | 2/2006 | Moskovich et al. |
| 2006/0052806 | A1 | 3/2006 | Xi et al. |
| 2006/0080794 | A1 | 4/2006 | Punshon |
| 2006/0195995 | A1 | 9/2006 | Moskovich et al. |
| 2006/0213018 | A1 | 9/2006 | Gross et al. |
| 2006/0272112 | A9 | 12/2006 | Braun et al. |
| 2007/0049956 | A1 | 3/2007 | Mythen |
| 2007/0251040 | A1 | 11/2007 | Braun et al. |
| 2008/0102953 | A1 | 5/2008 | Schultz |
| 2008/0189888 | A1 | 8/2008 | Hohlbein |
| 2008/0244849 | A1 | 10/2008 | Moskovich et al. |

* cited by examiner

TOOTHBRUSH

CROSS REFERENCE

This application claims the benefit of U.S. Provisional Application Ser. No. 61/416,112, filed on Nov. 22, 2010, the contents of which are incorporated herein by reference.

FIELD OF THE INVENTION

This invention relates to a personal hygiene device, specifically a toothbrush either powered or manual.

BACKGROUND OF THE INVENTION

Toothbrushes are widely accepted by consumers as one of the best instruments for preventing tooth decay. Early toothbrushes generally included a handle made of a single component with a plurality of filaments attached thereto. However, with the progression of technology, particularly in the areas of plastics processing, toothbrushes have become more complex. For example, some toothbrushes currently available have a handle which includes multiple plastic materials.

The utilization of multiple materials in a toothbrush often leads to manufacturing complexity. For example, in a first injection molding step, a body of the toothbrush may be produced. Additional injection molding steps may be required for each additional material placed on the body. While the additional materials can result in an aesthetically pleasing brush, the additional materials can also lead to additional manufacturing steps which results in a higher production cost.

Complex formations or shapes on the toothbrush can similarly lead to additional manufacturing steps and higher costs. As an example, some edges may be formed at an angle with respect to a longitudinal axis of the toothbrush which can lead to manufacturing complexity. In general, when an edge is angled, the molding operation for the angled edge can be more complicated than an edge which is generally perpendicular to the longitudinal axis. This is particularly applicable where the separation of mold halves is in the vertical direction (perpendicular to the longitudinal axis). The angled edge can cause an undercut. An undercut occurs, for example, when a mold cavity comprises an opening which has a smaller dimension than a portion of the toothbrush which the smaller dimension has to cross in order to achieve mold removal. Where an undercut is present a more complex molding operation may be utilized. For example, mold components which move laterally (perpendicular to the vertical direction) can be utilized. However, the implementation of such mold components complicates the molding operation and also increases the cost of production of the toothbrushes.

Accordingly, there is a need for toothbrush which includes complex features and/or shapes which can be produced via an injection molding operation.

BRIEF SUMMARY OF THE INVENTION

An oral care implement of the present invention can provide an aesthetically appealing brush which implements complex features while still maintaining a facilitated manufacturing profile. In some embodiments, an oral care implement comprises a base having a handle region, an oral engaging region, and a neck between the handle region and the oral engaging region. The base further comprises a recess that surrounds the handle and/or neck and has a first boundary and a second boundary. The first boundary is more distant from a distal end than the second boundary. The first boundary is disposed at an angle of greater than about 90 degrees with respect to a mold parting line of the oral care implement. The base comprises a first material, and a collar comprising a second material is disposed in the recess. Wherein, the second material is softer than the first material.

DETAILED DESCRIPTION OF THE DRAWINGS

An oral care implement constructed in accordance with the present invention can include complex features and/or shapes while utilizing an injection molding process which can avoid complex mold parts. Specifically, an oral care implement designed in accordance with the present invention can include complex shapes while utilizing vertical direction mold removal. While the embodiments described below are with regard to oral care implements, the teachings below are applicable to other personal care implements, e.g. grooming (blades, razors, shavers), or the like.

Figure 1A:
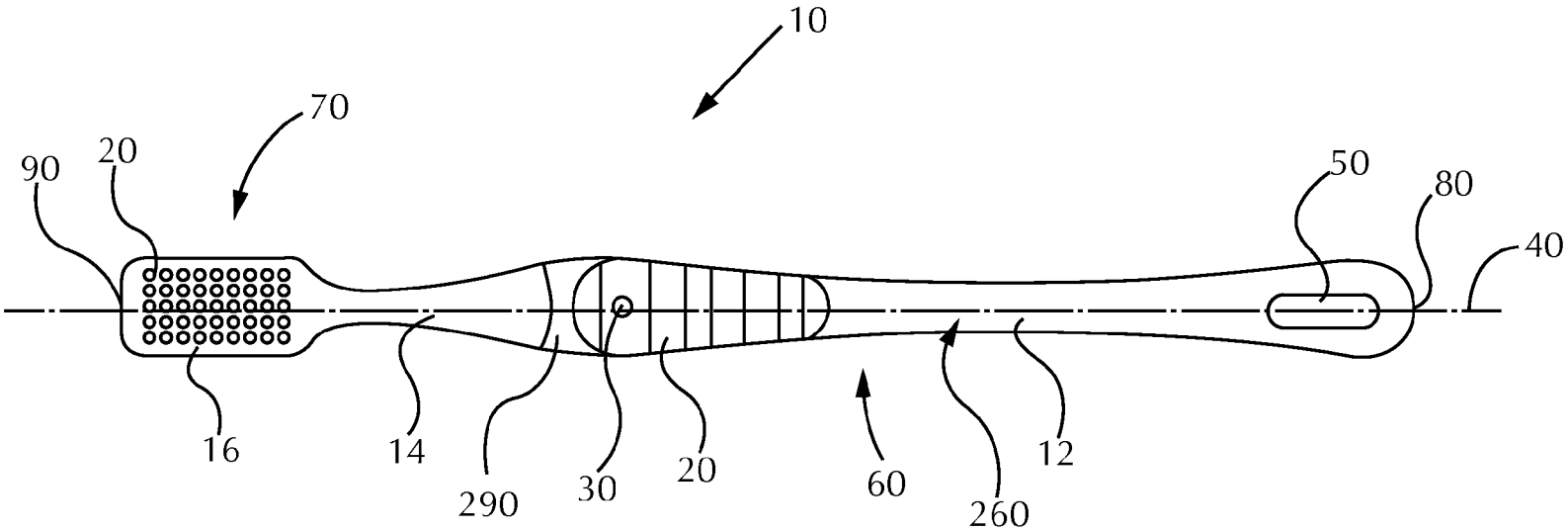
FIG. 1A is a plan view of a toothbrush constructed in accordance with an embodiment of the present invention.
Figure 1B:
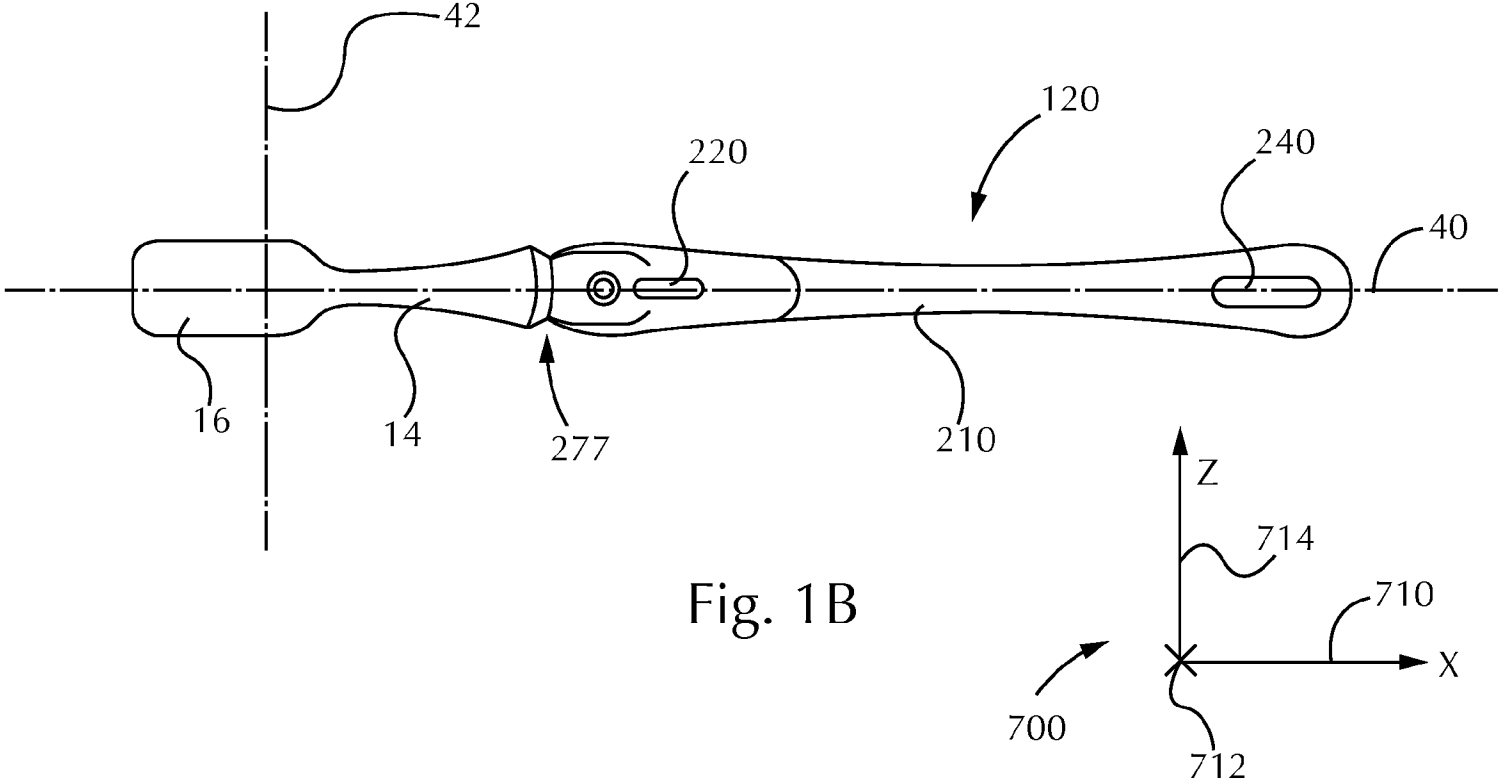
FIG. 1B is a plan view showing a base of the toothbrush of FIG. 1A.
Figure 2A:
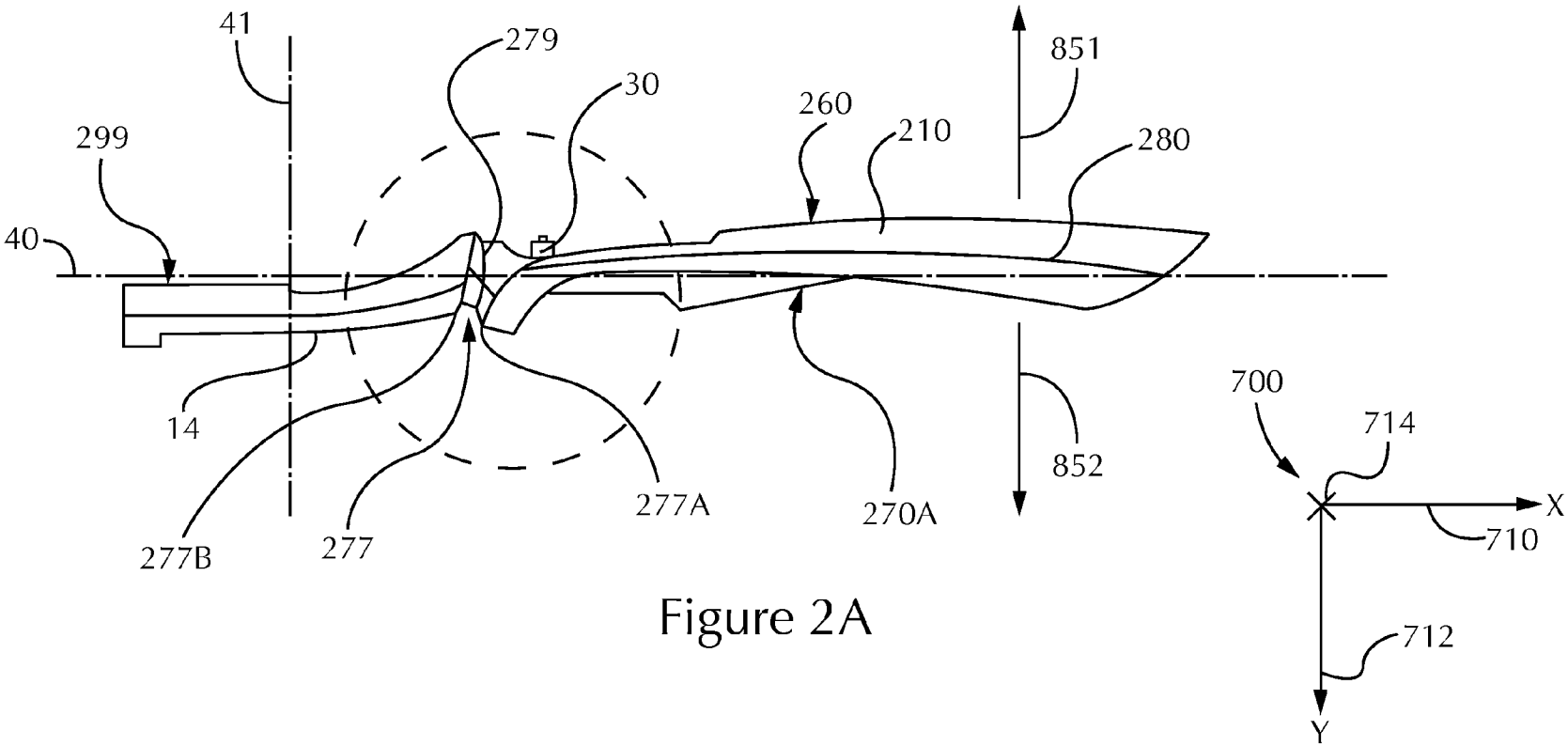
FIG. 2A is a side view of the base of FIG. 1B showing a transverse axis of the toothbrush.
Figure 2B:
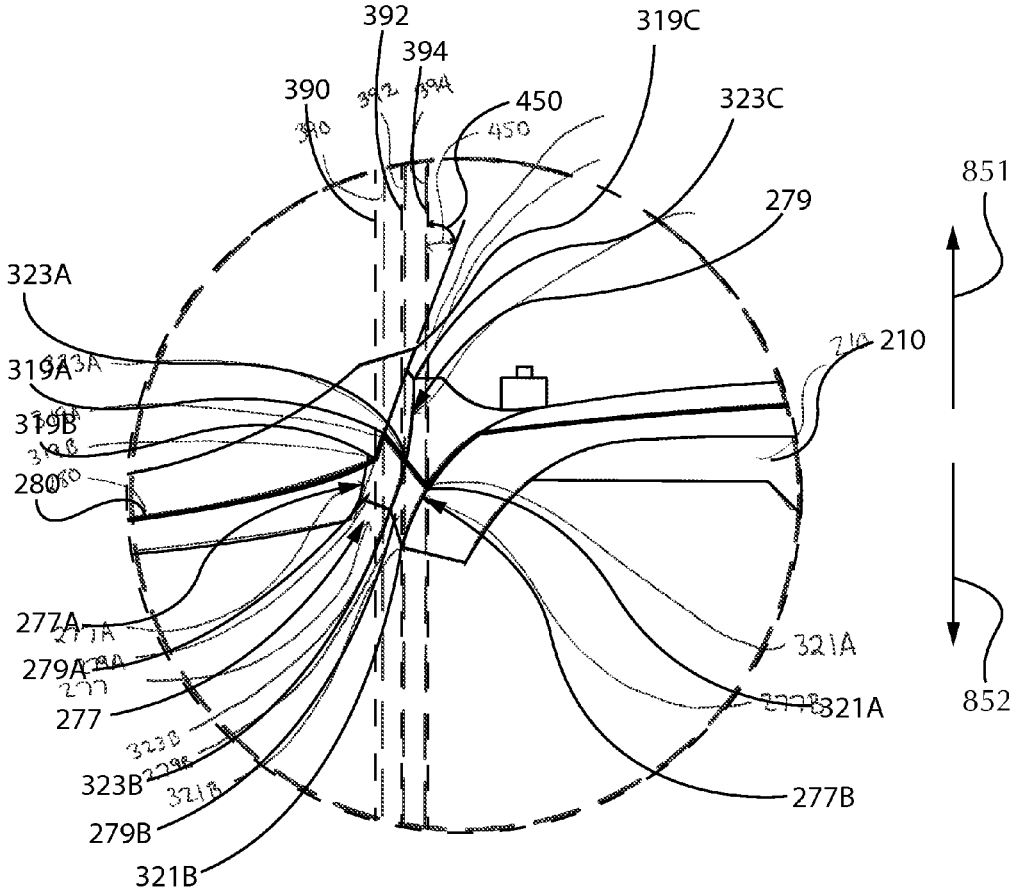
FIG. 2B is a close up side view of the base of FIG. 2A.

As shown in FIGS. 1A and 1B, an oral care implement, e.g. a toothbrush 10, constructed in accordance with the present invention may comprise a base 210 (shown in FIGS. 1B and 2A through 2B). The base 210 may comprise a gripping region 60 and oral engaging region 70. The gripping region 60 may comprise a portion of the handle 12, a first grip member 20 and a guidance element 30. As shown, the first grip member 20 may comprise an opening which allows the guidance element 30 to form part of a front side surface 260. The first grip member 20 at least partially overlays the gripping region 60.

A longitudinal axis 40 runs from a distal end 80 of the oral care implement 10 to a proximal end 90 of the oral care implement 10. A lateral axis 42 is perpendicular to the longitudinal axis 40 and generally parallel to a plane of a head 16.

The oral care implement 10 may further comprise a collar 290. The collar 290 may be unitarily formed with the first grip member 20. The base 210 may comprise a recess 277 in which the material for a collar 290 resides. The recess, e.g.277 and 1279 (shown in FIG. 7A), as discussed hereafter, can include complex angled features while still allowing for vertical mold removal. The recess, e.g. 277 and 1279, may be positioned in any suitable location. For example, the recess may be positioned between the handle 12 and a neck 14. In such embodiments, the recess may surround the neck 14. However, the principles provided herein can be utilized for producing an angled element in any location on the oral care implement. For example, the handle 12, the neck 14, the head 16, or combinations thereof, may comprise a collar as described herein.

The oral care implement 10 may further comprise the oral engaging region 70 which includes the head 16 and a plurality of contact elements 20. The neck 14 extends between the head 16 and the handle 12 thereby connecting the oral engaging region 70 and the griping region 60. The head 16 and/or the neck 14 may be angled with respect to the handle 12. Additionally, the head 16 may comprise an elevated surface 299 (shown in FIG. 2A) from which the contact elements 20 extend.

Figure 10:
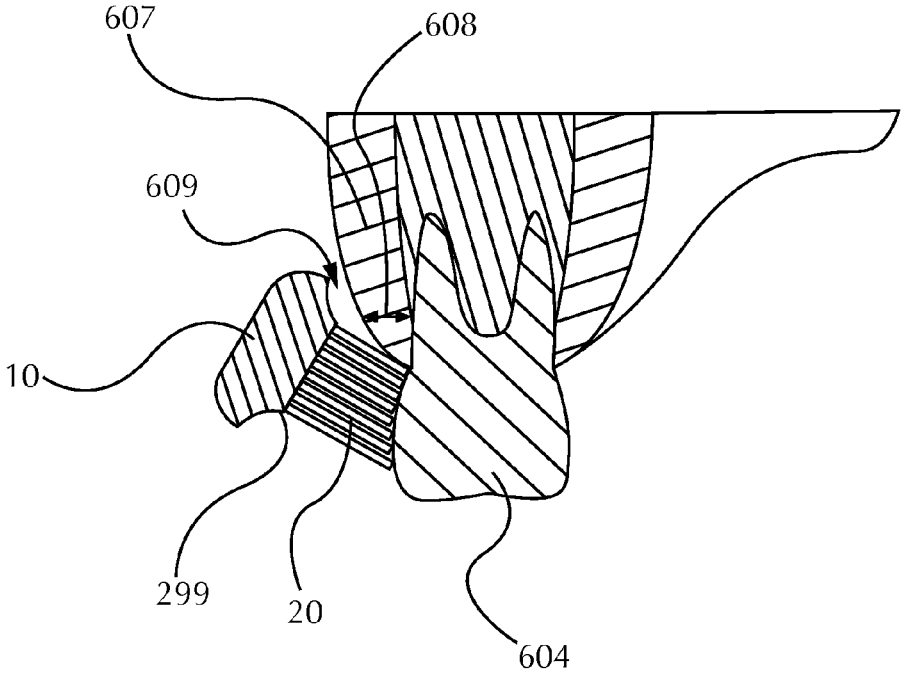
FIG. 10 is a representative view showing the toothbrush of FIG. 1 within a partial oral cavity.

The elevated surface 299 can provide better reach of the cleaning elements 20 to the tooth surface. As shown in FIG. 10, in general, gums 607 of a user can vary in thickness 608. This varying thickness 608 can define a distance between the brush 10 and a tooth 604. It is believed that because of the elevated surface 299, the contact elements 20 have better access to the teeth 604. As shown, a gap 609 between the brush 10 and the gums 607 may be present; however, because the brush 10 includes an elevated surface 299, a corner nearest the gap 609 is absent. The absence of this corner allows closer positioning of the cleaning elements 20 to the teeth 604. In contrast, conventional toothbrushes can include a rounded corner near the gap which can affect distance of the gap between the brush and the gums.

Referring back to FIGS. 1A and 1B, the toothbrush 10 may comprise an identification symbol 50. The identification symbol 50 may provide some visual indication of the type of oral care implement, the maker of the oral care implement, and/or the brand name of the oral care implement. In some embodiments, the identification symbol 50 may comprise a plurality of materials. For example, a hard material may be utilized to form specific alpha numeric characters or other symbols, while a soft material may surround or at least partially surround the alpha numeric characters or other symbols. As another example, a soft material may be utilized to form specific alpha numeric characters or other symbols, while a harder material may surround or at least partially surround the alpha numeric characters or other symbols.

As stated previously, the first grip member 20 may comprise an opening exposing the guidance element 30. The guidance element 30 may be unitarily formed with the base 210. Additionally, the guidance element 30 may comprise a material which is harder than that of the first grip member 20 in order to provide a tactile cue for a user.

Still referring to FIGS. 1A and 1B, the base 210 may comprise a first aperture 220 and a second aperture 240 in a handle region 120. Additional apertures extending through the base 210 may be utilized. The apertures, e.g. 220 and 240 can allow the first grip member 20 to be unitarily formed with a second grip member disposed on a backside of the base 210. The second grip member and the first grip member 20 may be attached to one another through the first aperture 220. Similarly, the identification symbol 50 may be unitarily formed with the second grip member and attached thereto via the second aperture 240.

The base 210 may comprises the recess 277 in which the material for a collar 290 resides. The collar 290 may be unitarily formed with the first grip member 20. The neck 14 of the base 210 may comprise a channel in which a strip of material may be disposed. The strip of material may connect the collar 290 with a tongue cleaner in the head 16. The strip of material, the tongue cleaner and the collar 290 may be unitarily formed.

Additionally, the base 210 in the oral engaging region 70 may comprise a plurality of indentations on a side of the head 16. The indentations can allow the material of the tongue cleaner to flow and form a plurality of elastomeric elements which extend from the elevated surface 299 of the head 16 of the oral care implement 10. In some embodiments, the plurality of elastomeric elements may be unitarily formed with the tongue cleaner.

During processing, the material utilized for the second grip member may be injection molded to the base 210. The injection molding operation can provide the material on a back surface 270A (shown in FIG. 2A) of the base 210 to form the second grip member. The material can flow through the first aperture 220 and the second aperture 240 thereby forming the first grip member 20 and the identification element 50. The material can flow through the recess 277 thereby forming the collar 290. The material can flow through the channel thereby forming the strip of material to the head 16 thereby forming the tongue cleaner. The material can flow through the indentations to form the plurality of elastomeric elements.

For those embodiments comprising elastomeric elements which are disposed inboard of the periphery of the head 16, apertures may be provided in the head 16 thereby allowing the material utilized for the tongue cleaner 292 to flow through the head 16 thereby forming the plurality of elastomeric elements. Additionally, for those embodiments comprising both elastomeric elements 291 which are disposed about the periphery and elastomeric elements disposed inboard of the periphery, both the indentations and apertures may be utilized to form the elastomeric elements. Embodiments are contemplated where each of the plurality of elastomeric elements 291 is integral with one another and/or integral with the tongue cleaner 292. For those embodiments where the plurality of elastomeric elements 291 is disposed inboard of the periphery of the head 16, the plurality of elastomeric elements 291 may be integral with each other. Additionally, for such embodiments, the plurality of elastomeric elements 291 may be integral with the tongue cleaner 292. For example, the plurality of elastomeric elements 291 may extend through apertures in the head 16 and integrally extend from the tongue cleaner 292.

Uniquely, the flow of material across the base 210 may be from the back surface 270A to the front side surface 260 and then to the back surface 270A again. This configuration, can provide an elaborate appearance for the toothbrush 10 without the use of a third material for the handle 12, neck 14, and/or head 16. For example, this configuration allows there to be a separation on the back surface 270A between the second grip member and the collar 290. This separation can be aesthetically appealing. Moreover, the separation between the second grip member and the collar 290 can provide some tactile sensation to the user. Since the collar 290 and the second grip member are separated, a harder material may be provided in the separation between the collar 290 and the second grip member. The harder material can provide additional resistance to the second grip member in the area of the separation as opposed to areas disposed away from the separation.

As described above, the second grip member, the first grip member 20, the identification element 50, the collar 290, the strip of material, the tongue cleaner, and/or the plurality of elastomeric elements may be unitarily formed. However, in some embodiments, at least one of these, e.g. the second grip member, the first grip member 20, the identification element 50, the collar 290, the strip of material, the tongue cleaner, and/or the plurality of elastomeric elements, may be discretely formed and attached to the base 210. While potentially more complicated during manufacturing, such embodiments allow for some flexibility in the material selection for these features.

As shown in FIGS. 2A and 2B, the recess 277 for the collar 290 can surround the neck 14. The recess 277 may comprise a first boundary 277A and a second boundary 277B. The first boundary 277A may be adjacent the neck 14 while the second boundary 277B may be adjacent the first grip member 20. The recess 277 may comprise an intermediate area 279 disposed between the first boundary 277A and the second boundary 277B.

The mold parting line 280 can intersect the first boundary 277A and the second boundary 277B at the points of intersection 319 and 321, respectively. Even with the angles / curvature of the first boundary 277A and/or the second boundary 277B, molds utilized to make the body 210 may be removed in a vertical direction. For example, a first mold half can be removed in a first direction 851 while a second mold half can be removed in a second direction 852 which is opposite the first direction 851.

As shown in FIGS. 1B and 2A, the first direction 851 and the second direction 852 area generally parallel to a Y axis 712 of the coordinate system 700. Similarly, a transverse axis 41 is generally parallel to the Y axis 712. The longitudinal axis 40 is generally parallel to an X axis 710 while the lateral axis 42 is generally parallel with a Z axis 714.

Referring back to FIGS. 2A and 2B, the first boundary 277A and or the second boundary 277B may be inclined with respect to a transverse axis 41 or a line parallel thereto, which is perpendicular to the longitudinal axis 40. An angle 450 of the first boundary 277A can be greater than about 5 degrees, greater than about 10 degrees, greater than about 15 degrees, greater than about 20 degrees, greater than about 30 degrees, and/or less than about 30 degrees, less than about 20 degrees, less than about 15 degrees, less than about 10 degrees, or any range or any number within the degrees stated above.

In some embodiments, the angle 450 can be oriented opposite as shown in FIG. 2B. For example, as shown in FIG. 2B, angle 450 is inclined toward the distal end 80 (shown in FIG. 1A) of the toothbrush 10. However, embodiments are contemplated where the angle 450 is inclined toward the proximal end 90 (shown in FIG. 1A) of the toothbrush 10. The angle 450 can be any suitable degree measure regardless of inclination. Some examples of suitable degree measures are provided above. The orientation of the angle 450 toward the proximal end of the brush can be greater than about 5 degrees, greater than about 10 degrees, greater than about 20 degrees, greater than about 30 degrees, greater than about 40 degrees, greater than about 50 degrees, greater than about 60 degrees, and/or less than about 70 degrees, less than about 60 degrees, less than about 50 degrees, less than about 40 degrees, less than about 30 degrees, less than about 20 degrees, less than about 10 degrees, or any number or any range within the values provided above.

The second boundary 277B may be inclined at the same angle. However, in some embodiments, the second boundary 277B may be inclined with respect to the transverse axis 41 by greater than about 10 degrees, greater than about 20 degrees, greater than about 30 degrees, greater than about 40 degrees, greater than about 50 degrees, greater than about 60 degrees, greater than about 70 degrees, and/or less than about 70 degrees, less than about 60 degrees, less than about 50 degrees, less than about 40 degrees, less than about 30 degrees, less than about 20 degrees, less than about 10 degrees, or any range or any number within the degrees stated above.

Figure 3A:
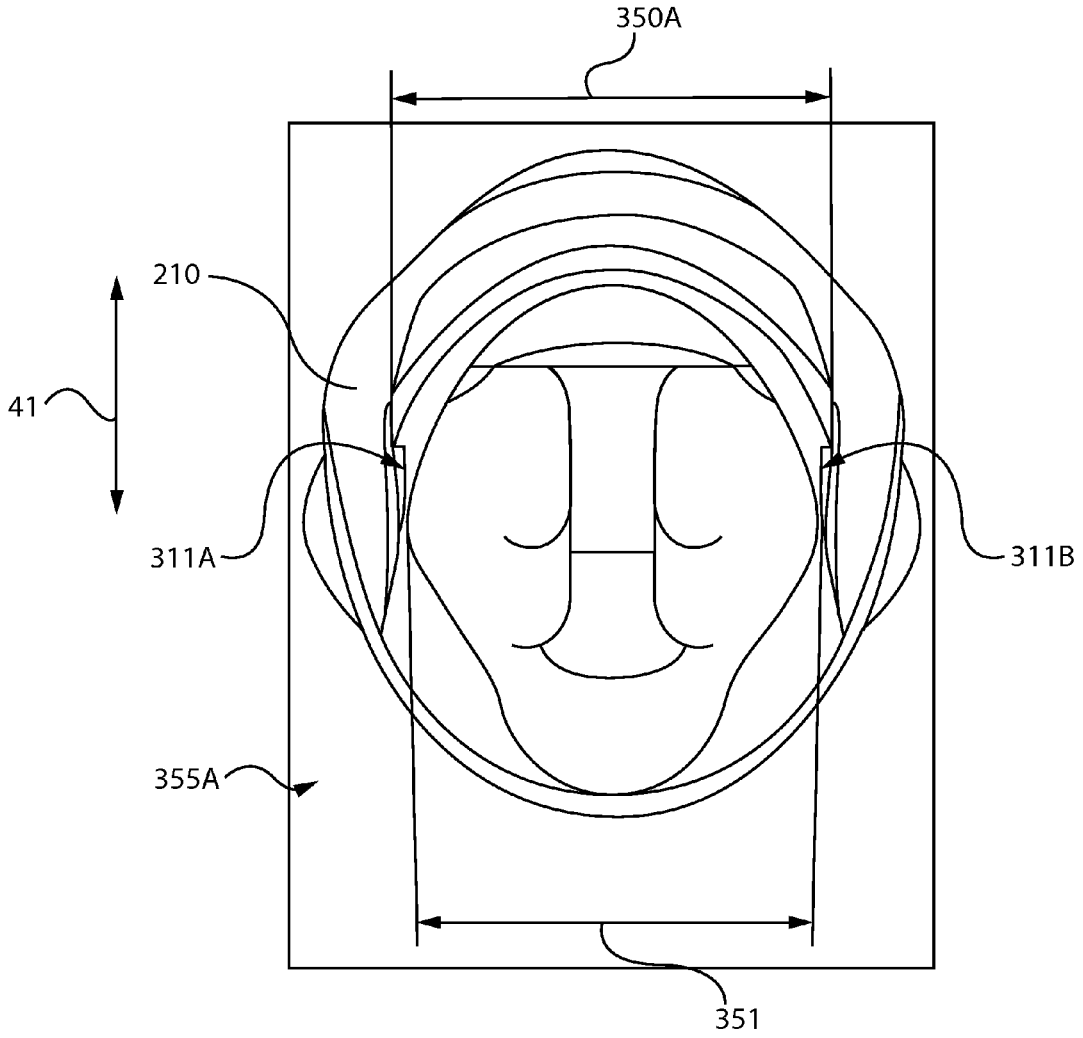
FIG. 3A is a cross section showing the base of FIG. 2A along a plane parallel to the transverse axis and extending through an intermediate first boundary point.
Figure 3B:
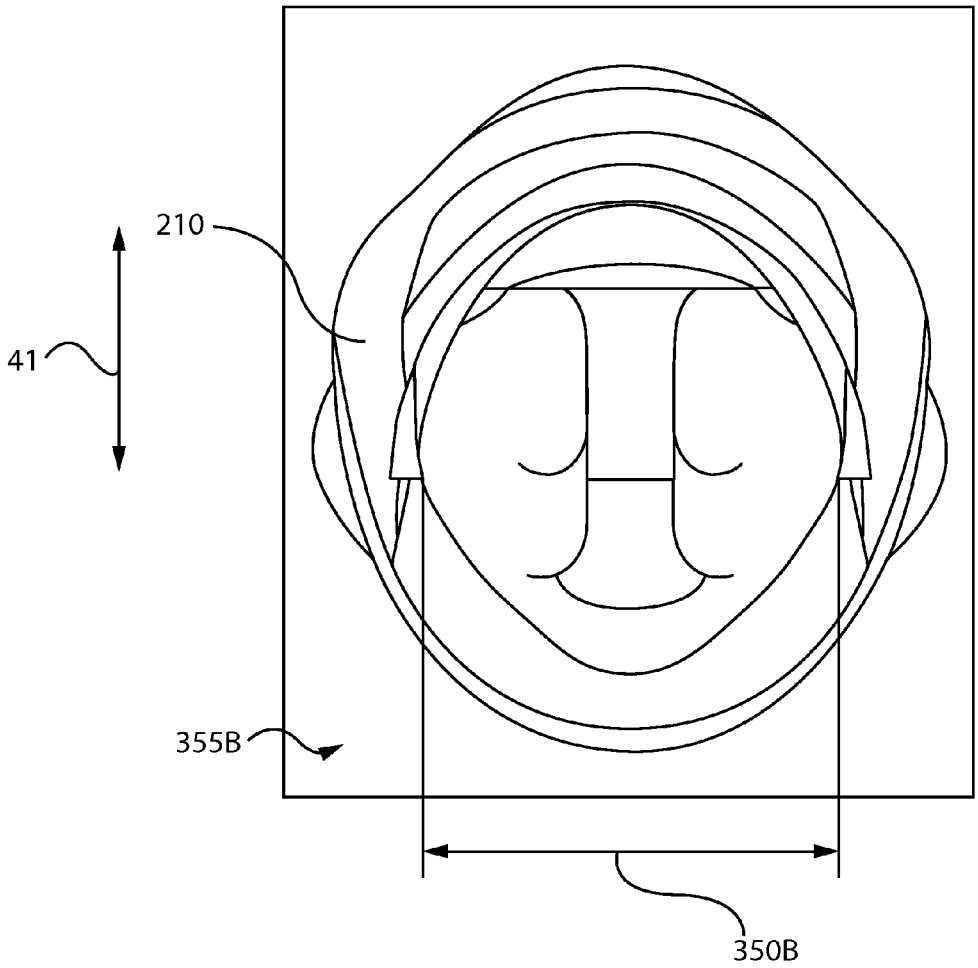
FIG. 3B is a cross section showing the base of FIG. 2A along a plane parallel to the transverse axis and extending through a lower first boundary point.
Figure 3C:
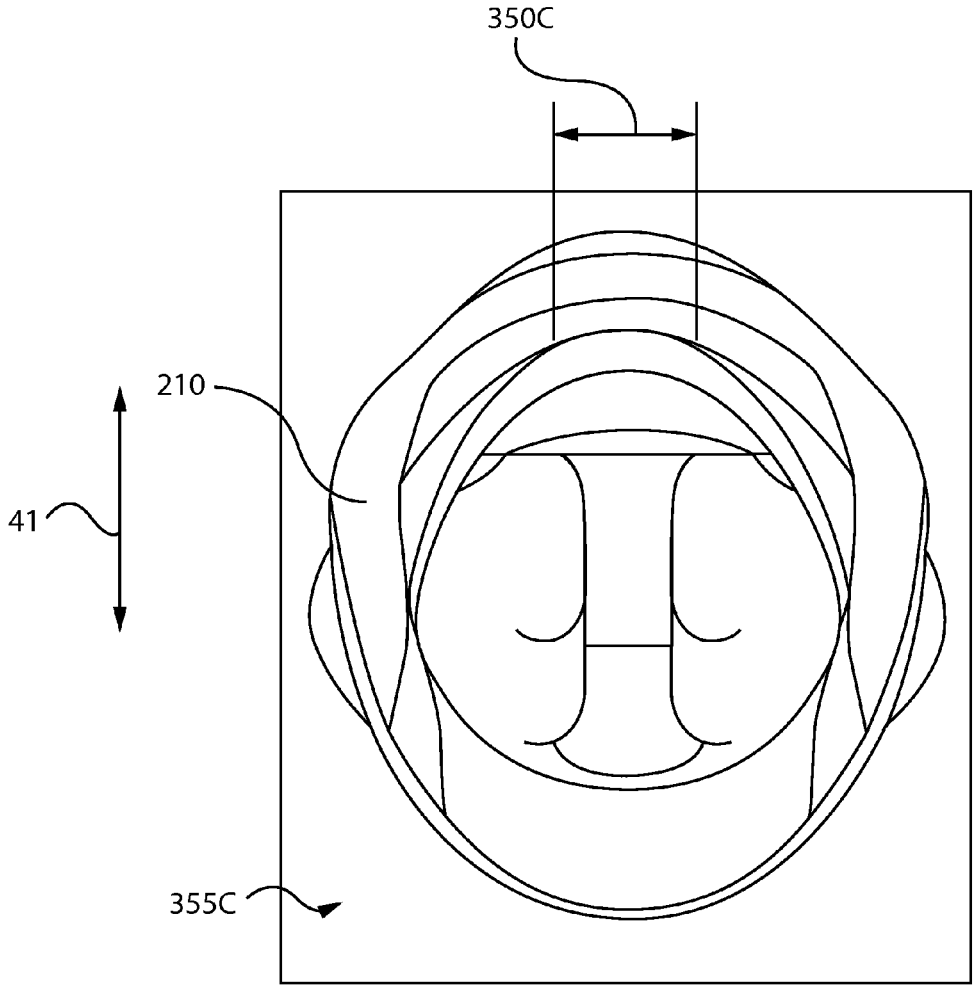
FIG. 3C is a cross section showing the base of FIG. 2A along a plane parallel to the transverse axis and extending through an upper first boundary point.

In order to accommodate vertical mold removal, the width of the body 210 at various points can be important. Referring to FIGS. 2A, 2B, and 3A-3C, along the first boundary 277A, the base 210 may comprise an intermediate first boundary width 350A which extends through an intermediate first boundary point 319A which is at the intersection of the mold parting line 280 and the first boundary 277A. Still along the first boundary 277A, the base 210 may comprise a lower first boundary width 350B which extends through a lower first boundary point 319B which is along the mold parting line 280 and the first boundary 277A and subjacent to the intermediate first boundary point 319A. Along the first boundary 277A, the base 210 may comprise an upper first boundary width 350C extends through an upper first boundary point 319C which is in the top most portion of the first boundary 277A. Each of the cross sections shown in FIGS. 3A through 3C is taken in a plane, e.g. 355A, 355B, and 355C, respectively, each of which is parallel to the transverse axis 41. Additionally, each of the widths 350A, 350B, and 350C are generally parallel to the lateral axis 42 (shown in FIG. 1B).

Figure 4A:
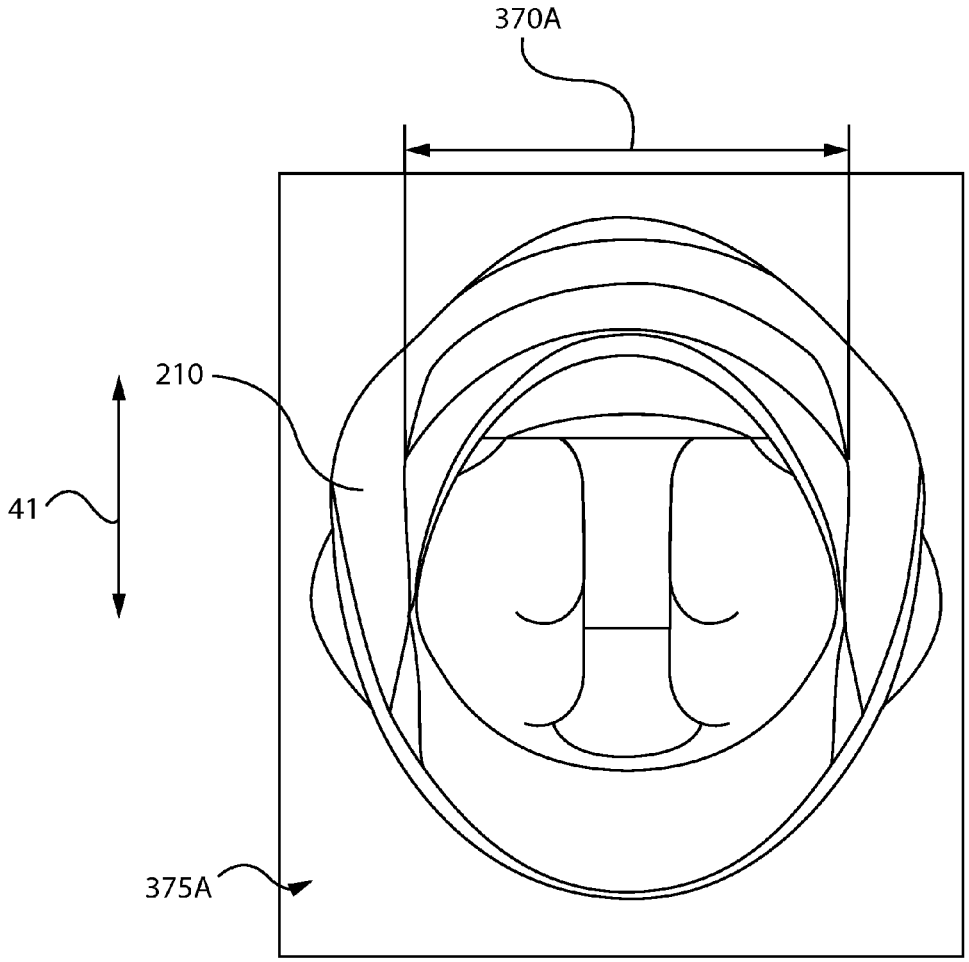
FIG. 4A is a cross section showing the base of FIG. 2A along a plane parallel to the transverse axis and extending through a primary intermediate point.
Figure 4B:
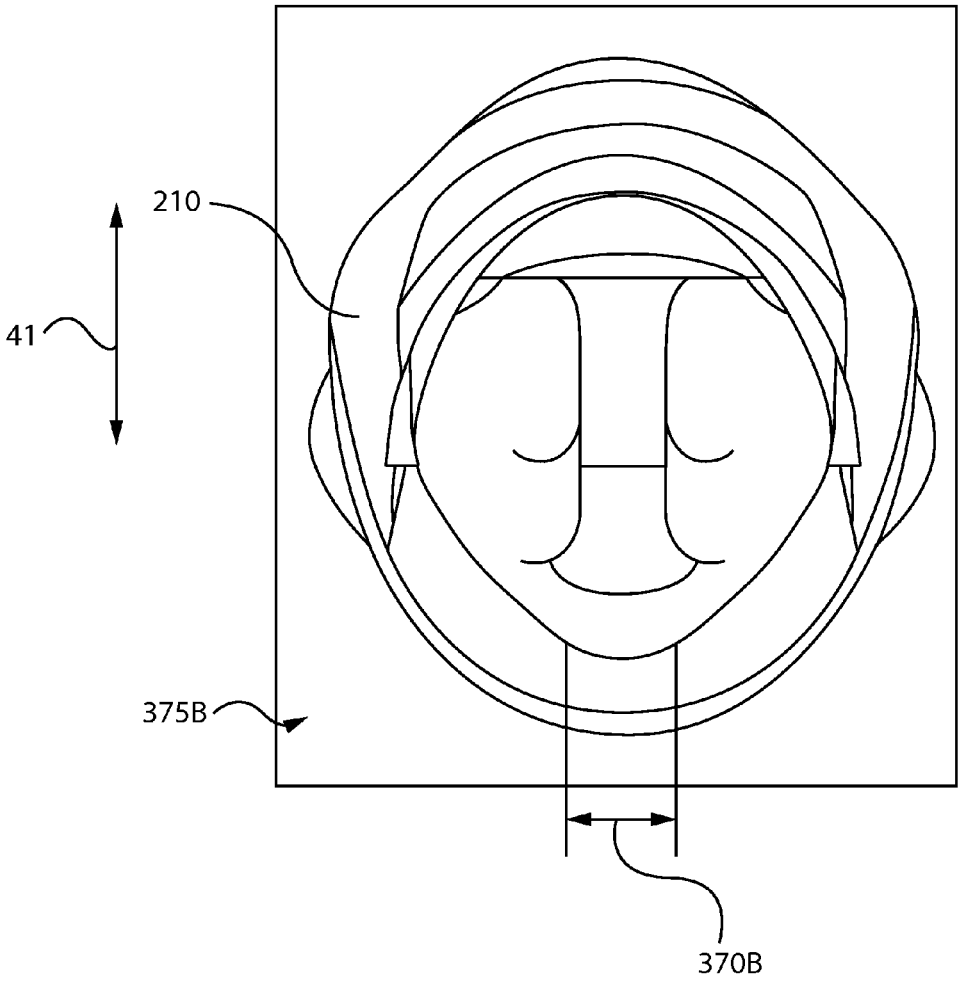
FIG. 4B is a cross section showing the base of FIG. 2A along a plane parallel to the transverse axis and extending through a lower intermediate point.
Figure 4C:
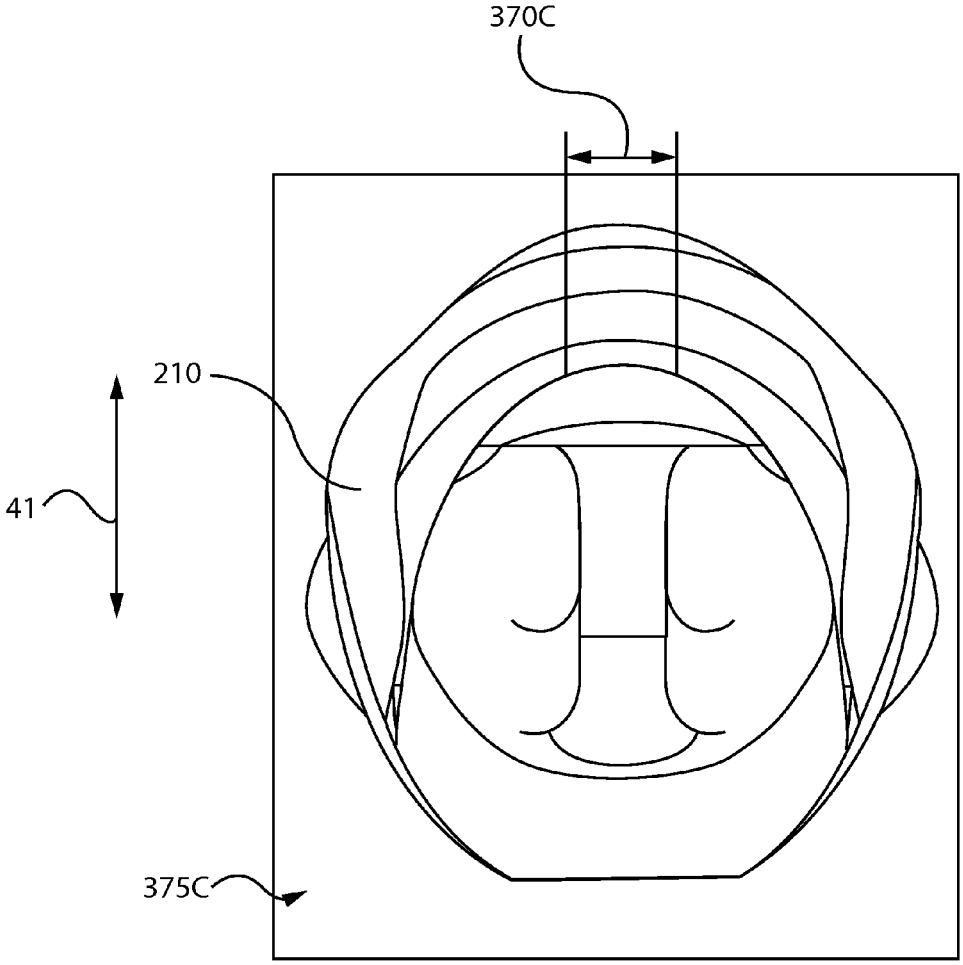
FIG. 4C is a cross section showing the base of FIG. 2A along a plane parallel to the transverse axis and extending through an upper intermediate point.

Referring to FIGS. 2A, 2B and 4A through 4C, in the intermediate area 279 a base 210 may comprise a primary intermediate width 370A which extends through a primary intermediate area point 323A, where the mold parting line 280 intersects the thinnest portion (with respect to the width) of intermediate area 279. Still in the intermediate area 279, a base 210 may comprise a lower intermediate area width 370B which extends through a lower intermediate area point 323B. The lower intermediate area point 323B forms a portion of the back surface 270A in the intermediate area 279 and is at the thinnest portion (with respect to the width) of intermediate area 279. The base 210 may further comprise an upper intermediate area width 370C extends through an upper intermediate area point 323C. The upper intermediate area point 323C is on the front surface 260 and is at the thinnest portion (with respect to the width) of intermediate area 279. Each of the cross sections shown in FIGS. 4A through 4C is taken in a plane, e.g. 375A, 375B, and 375C, respectively, each of which is parallel to the transverse axis 41. Additionally, each of the widths 370A, 370B, and 370C are generally parallel to the lateral axis 42 (shown in FIG. 1B).

Referring to FIGS. 2A, 2B, and 5A, through 5B, along the second boundary 277B, the base 210 may comprise an intermediate second boundary width 360A which extends through an intermediate second boundary point 321A which is at the intersection of the mold parting line 280 and the second boundary 277B. Still along the second boundary 277B, the base 210 may comprise a lower second boundary width 360B which extends through a lower second boundary point 321B which is disposed subjacent to the intermediate second boundary point 321A and along the second boundary 277B. The lower second boundary point 321B is on the back surface 270A.

Referring to FIGS. 3A-3C, 4A-4C, and 5A-5B, the intermediate first boundary width 350A may be any suitable distance. The determination of suitable distance may depend on the type of material utilized for the base 210. For example, the intermediate first boundary width 350A should be sized to preclude breaking and/or fatigue failure in an area of the intermediate first boundary width 350A, the intermediate second boundary width 360A, and the primary intermediate width 370A. The intermediate second boundary width 360A may be greater than about 5 mm, greater than about 6 mm, greater than about 7 mm, greater than about 8 mm, greater than about 9 mm, greater than about 10 mm, greater than about 11 mm, greater than about 12 mm, greater than about 13 mm, greater than about 15 mm, greater than about 16 mm, and/or less than about 16 mm, less than about 15 mm, less than about 14 mm, less than about 13 mm, less than about 12 mm, less than about 11 mm, less than about 10 mm, less than about 9 mm, less than about 8 mm, less than about 7 mm, less than about 6 mm, or any individual number or ranges with the distances provided. In some embodiments, the intermediate second boundary width 360A may be about 10.7 mm.

The intermediate first boundary width 350A may be any suitable distance, and in some embodiments, may have the same distance as that of the intermediate second boundary width 360A described above. In some embodiments, the intermediate first boundary width 350A can be about 10.6 mm. Similarly, the primary intermediate width 370A may be any suitable distance, and in some embodiments, may have the same distance as that of the intermediate second boundary width 360A described above. In some embodiments, the primary intermediate width 370A may be about 10.1 mm.

Referring back to FIGS. 2A and 2B, 3A-3C, 4A-4C, and 5A-5B, in order to accommodate simplified mold removal along the mold part line 280 in the first direction 851 and the second direction 852, the widths previously described herein should be carefully configured.

For example, for the intermediate first boundary width 350A, removal of the mold cavity occurs along a first reference line 390. For a first mold portion which is removed the first direction 851, a first undercut could occur between the intermediate first boundary point 319A and the upper first boundary point 319C in the intermediate area 279. To avoid the potential for an undercut, the base 210 should have no width along the first boundary 277A which is greater than that of the intermediate first boundary width 350A. Also, the base 210 should have no width along the thinnest portion of the intermediate area 279 which is greater than that of the primary intermediate width 370A. It should be noted that the intermediate area 279 may comprise transitions 279A and 279B which may have a larger widths than the primary intermediate width 370A.

In some embodiments, the widest portion of the base 210 (width being parallel to the lateral axis 42 shown in FIG. 1B) should be along or adjacent the mold removal line 280. For example, as stated previously, for the mold removal in the first direction 851, the first reference line 390 indicates a path of travel for a mold portion forming the intermediate first boundary width 350A. Along the first reference line 390 (in the first direction 851), the widest portion of the base 210 may be at the intermediate first boundary width 350A.

A second reference line 392 indicates the path of travel for a mold portion forming the primary intermediate width 370A. Along the second reference line 392 (in the first direction 851), the widest portion of the base 210 may be at the primary intermediate width 370A.

A third reference line 394 indicates the path of travel for a mold portion forming the intermediate second boundary width 360A. Along the third reference line 394 (in the first direction 851), the widest portion of the base 210 may be at the intermediate second boundary width 360A.

For a second mold portion which is removed in the second direction 852, a second undercut could occur between intermediate second boundary point 321A and the lower second boundary point 321B in the intermediate area 279 in transition 279B. To avoid the potential for an undercut, the base 210 should have no width along the second boundary 277B which is greater than that of the intermediate second boundary width 360A. Also, the base 210 should have no width along the thinnest portion of the intermediate area 279 which has a greater width than that of the primary intermediate width 370A.

For mold removal in the second direction 852, the widest portion of the base 210 should be along or adjacent the mold parting line 280. The first reference line 390 also indicates the path of travel for a mold portion forming a secondary first boundary width 351 (shown in FIG. 3A). As shown in FIG. 3A, the secondary first boundary width 351 is slightly less than that of the intermediate first boundary width 350A. However, because the secondary first boundary width 351 is formed by the lower mold portion, the smaller secondary first boundary width 351 does not create an undercut with regard to an upper mold portion. Referring back to FIGS. 2A and 2B, along the first reference line 390 (in the second direction 852) the widest portion of the base 210 may be at the secondary first boundary width 351 (shown in FIG. 3A).

The second reference line 392 indicates the path of travel for the mold portion forming the primary intermediate width 370A. Along the second reference line 392 (in the second direction 852), the widest portion of the base 210 may be at the primary intermediate width 370A.

Figure 5A:
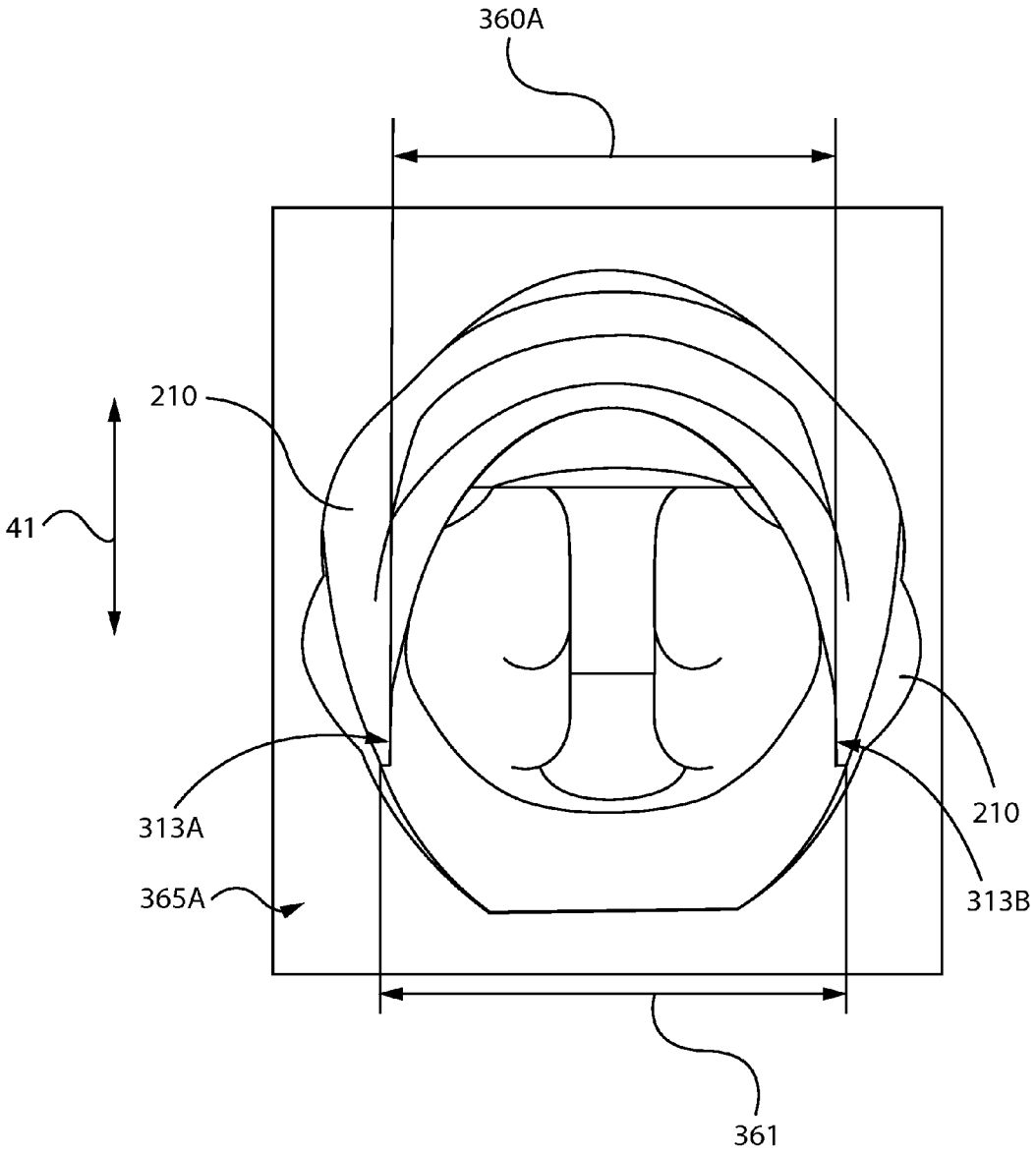
FIG. 5A is a cross section showing the base of FIG. 2A along a plane parallel to the transverse axis and extending through an intermediate second boundary point.
Figure 5B:
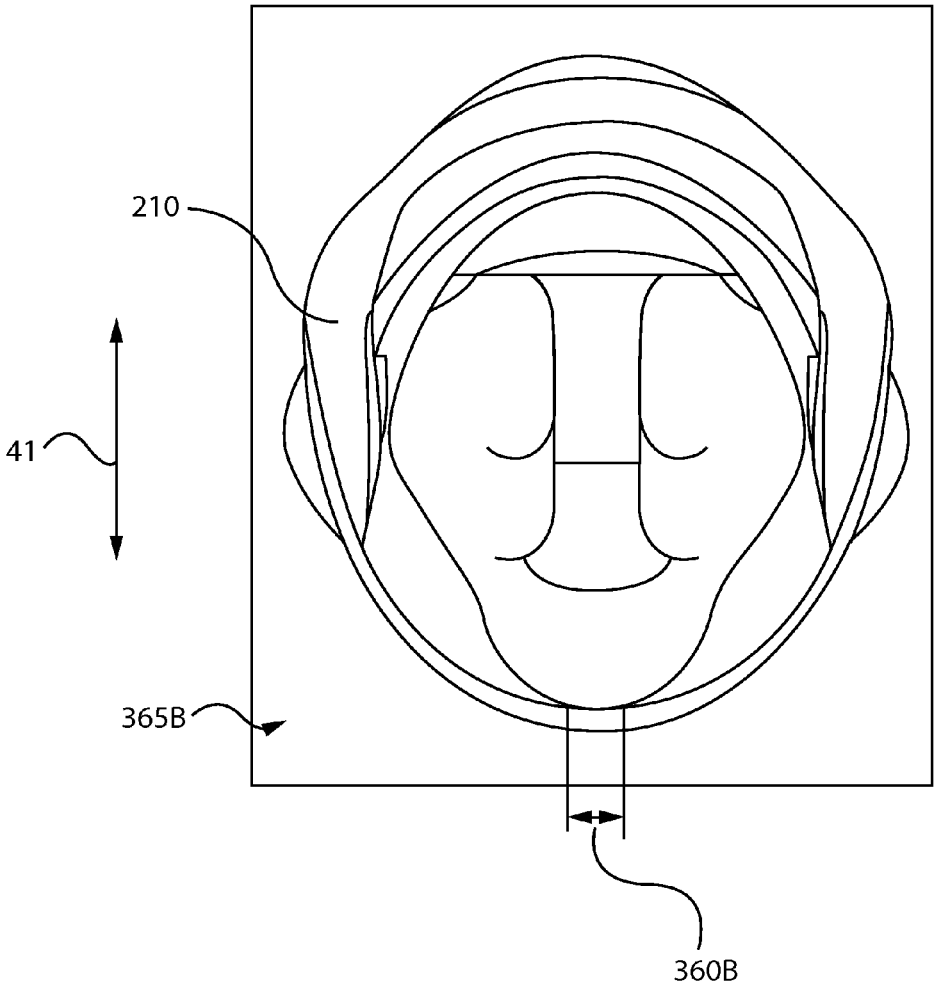
FIG. 5B is a cross section showing the base of FIG. 2A along a plane parallel to the transverse axis and extending through a lower second boundary point.

The third reference line 394 indicates the path of travel for the mold portion forming a secondary second boundary width 361 (shown in FIG. 5A). The secondary second boundary width 361 is slightly larger than the intermediate second boundary width 360A; however, because the intermediate second boundary width 360A is formed by the upper portion of the mold while the secondary second boundary width 361 is formed by the lower portion of the mold, no undercut is present. Referring back to FIGS. 2A and 2B, along the third reference line 394 (in the second direction 852) the widest portion of the base 210 may be at the secondary second boundary width 361 (shown in FIG. 5A).

Configuration of the widths described heretofore can greatly reduce the likelihood of the existence of an undercut. As such, the configuration of the base 210 as described herein, can provide an aesthetically pleasing brush while utilizing vertical mold removal along the first direction 851 and the second direction 852.

Figure 6:
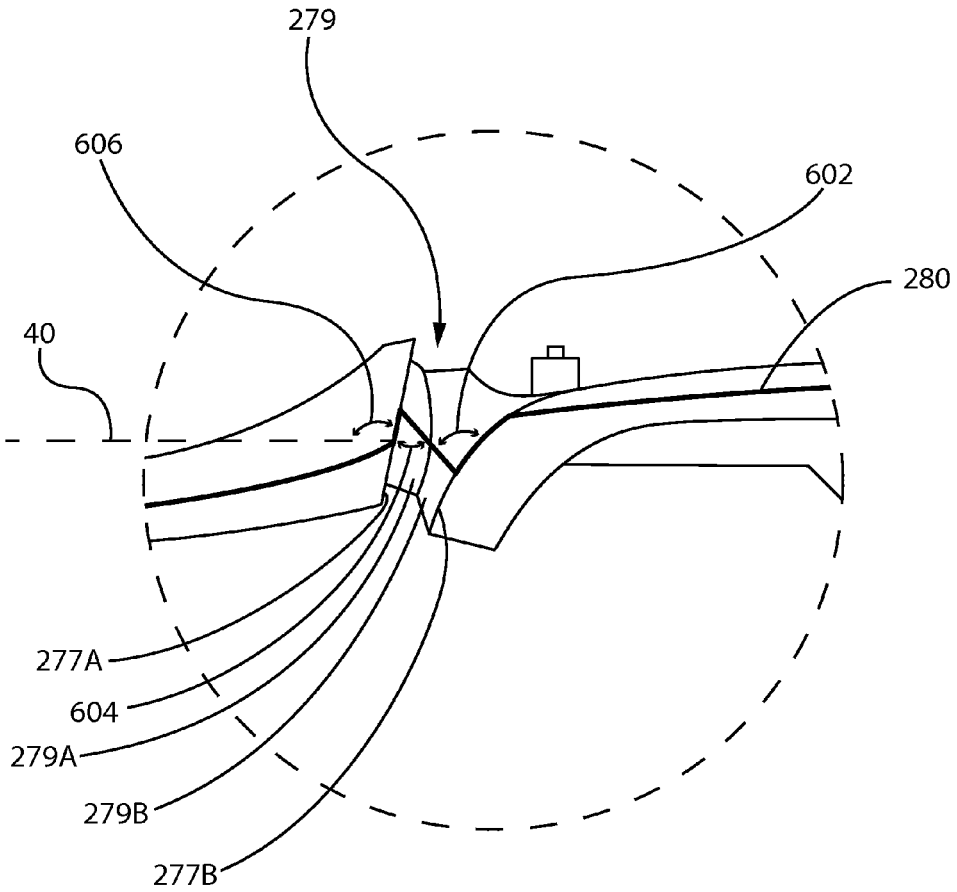
FIG. 6 is a close up side view of the base of FIG. 2A.

As shown in FIG. 6, the mold parting line 280 may be angled in the intermediate area 279 in order to accommodate the removal of mold halves in the first direction 851 and the second direction 852. A first angle 602 between the second boundary 277B and the mold parting line 280 in the transition 279B can be about 78.94 degrees. A second angle 604 between the mold parting line 280 in the transition 279A and the first boundary 277A can be about 57.20 degrees. A third angle 606 between the mold parting line 280 along the first boundary 277A and the longitudinal axis 40 can be about 107.20 degrees. Any suitable angle can be utilized.

Referring back to FIG. 2B, for complex geometries, i.e. angled features, the coordination of the widths can be quite challenging. For example, if a cross section along the first boundary 277A included a constant width which was greater than the primary intermediate width 370A, then the second reference line 392 could not intersect the first boundary 277A and still maintain a vertical mold removal in the first direction 851 without the use of complex molding components. However, where the cross section along the first boundary 277A includes a variable width, the second reference line 392 may intersect the first boundary 277A depending on the width of the base 210 at a point of intersection between the reference line 392 and the first boundary 277A.

As discussed above, the width of the base 210 at particular locations of the toothbrush can reduce the likelihood of undercuts. However, the selection of the widths should take into consideration the comfort and feel of the toothbrush. So, while a wide angle may be achievable on the first boundary 277A, the trade off may be that at the intersection between the second reference line 392 and the first boundary 277A, the width of the base 210 has to be relatively small. This design may cause discomfort to the user and/or may facilitate perceptions in the mind of a consumer regarding an uncomfortable brush. Additionally, the smaller width of the base 210 may increase the likelihood of material failure, e.g. fatigue failure.

In some embodiments, a wide angle is employed for the second boundary 277B; however, in order to accommodate the widths which facilitate vertical mold removal in the second direction 852, the primary intermediate width 370A may have to be increased to accommodate the lower second boundary width 360B assuming that the second reference line 392 and the second boundary 277B intersect. The increase of the primary intermediate width 370A can reduce the depth of the recess 277 in which the material for the collar 290 (shown in FIG. 1A) is deposited. Additionally, the reduced depth in the recess 277 can detrimentally affect the appeal of the toothbrush. For example, where a second material disposed in the recess 277 is an elastomeric composition which provides a soft grip for a user, a reduced depth can equal less thickness to the elastomeric composition in the recess 277. The reduced thickness can reduce the amount of cushioning that the elastomeric composition provides to the user. Additionally, the reduced thickness of the elastomeric composition can also encourage translucency in the elastomeric composition. This translucency can provide an unintended and unpleasant visual effect for the user.

In some embodiments, the second reference line 392 intersects the second boundary 277B. In some embodiments, the second reference line 392 does not intersect the second boundary 277B. In some embodiments, the second reference line 392 intersects the first boundary 277A. In some embodiments, the second reference line does not intersect the first boundary 277A.

Figure 7A:
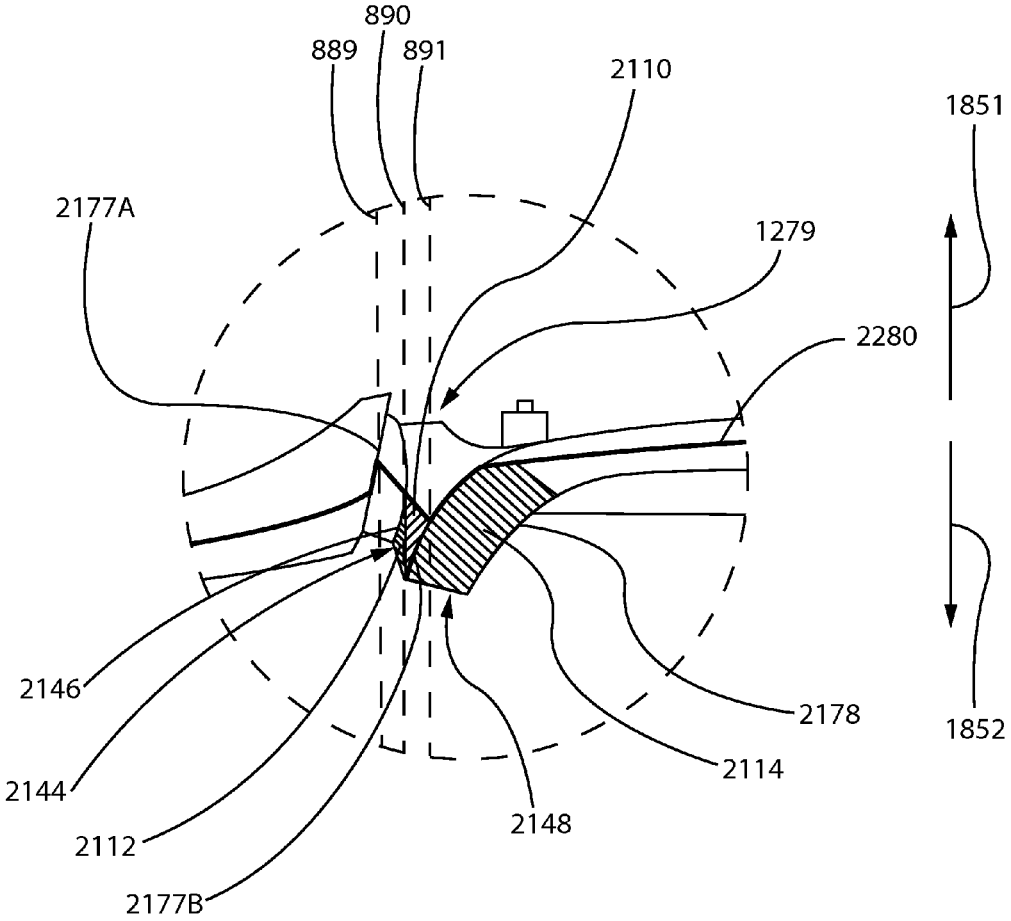
FIG. 7A is a close up side view of the base of FIG. 2A.

For the embodiments, described hereafter, the collar, tongue cleaner, strip of material, first grip member, and second grip member may be included therewith. Referring to FIG. 7A, in some embodiments, simplified mold removal e.g in a first direction 1851 and in a second direction 1852, can be achieved by appropriately designing three dimensional features on a toothbrush. For example, by appropriately designing the recess 1279 with a first section 2110, a second section 2112, and a third section 2114, appropriately, undercuts can be eliminated for the second mold removal direction 1852. Simplified mold removal occurs when the toothbrush and molds are created to avoid undercuts. The first section 2110, second section 2112, and third section 2114, can be designed with respect to the three dimensional coordinate system 700 shown in FIG. 7B.

Still referring to FIG. 7A, the first section 2110 is defined by a mold parting line 2280, a second boundary 2177B, and a second reference line 890 generally parallel to the transverse axis 42 (shown in FIG. 2A). The second section 2112 is defined by the second reference line 890, an intermediate surface 2144, and an intermediate side surface 2146. The intermediate side surface 2146 represents the thinnest portion of the recess 1279. The third section 2114 is defined, in part, by the second boundary 2177B, an outer surface 2148, an outer boundary 2178, and the mold parting line 2280.

To avoid undercuts, the first section 2110 should be designed such that a mold portion can be removed in the second direction 1852. Similarly, the second section 2112 and the third section 2114 should be designed to accommodate second mold removal direction 1852. Each of the first section 2110, the second section 2112, and the third section 2114 can be designed as described heretofore, e.g. regarding the relative widths of the toothbrush. Additionally, other features may be utilized to accommodate the mold removal directions 1851 and/or 1852. For example, the first section 2110, the second section 2112, and the third section 2114 may be designed such that they are inclined with respect to the Y axis 712 (shown in FIG. 7B). For the sake of clarity, the Y axis 712 is generally parallel to the first direction 1851 and the second direction 1852.

Figure 7B:
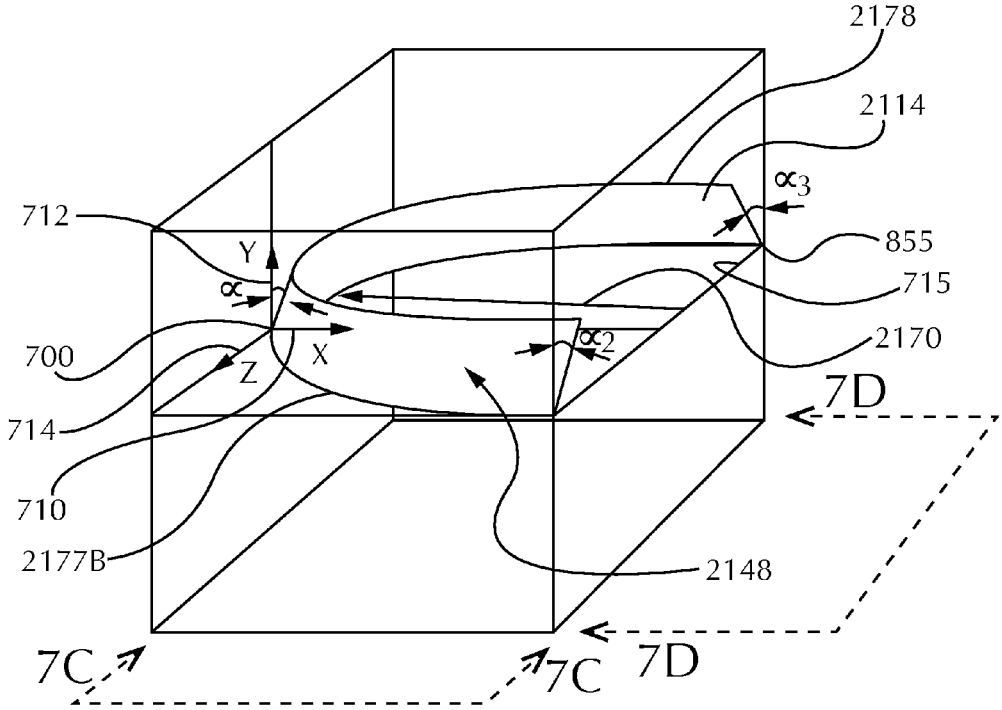
FIGS. 7B, 7C, and 7D, are partial perspective views showing a third section of an intermediate area of the toothbrush of FIG. 1 with all other features of the toothbrush removed for clarity.
Figure 7C:
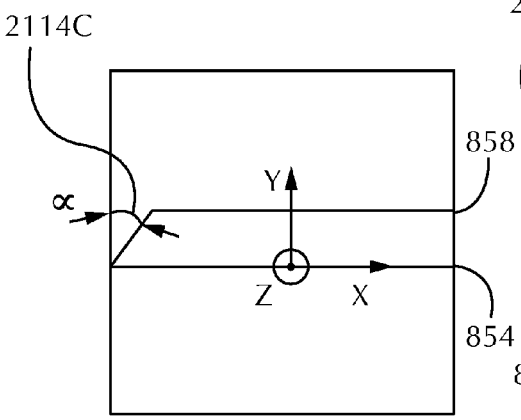
Figure 7D:
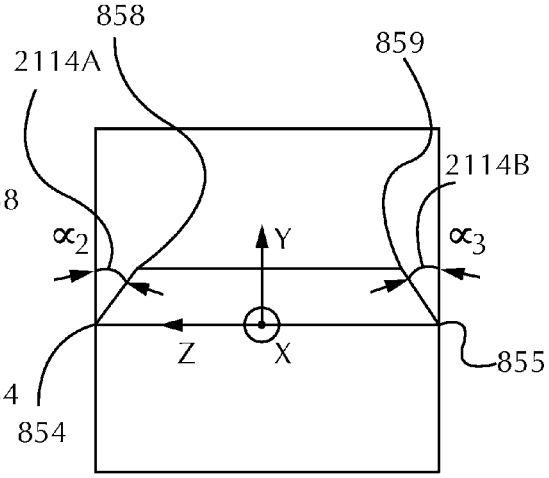

Design of the third section 2114 to facilitate mold removal is discussed below. As shown in FIGS. 7B through 7D, the third section 2114 is bounded, in part, by the second boundary 2177B and the outer boundary 2178. The third section 2114 has a first starting point 854 and a first ending point 855. At the first starting point 854, the third section 2114 has a first angle 2114A of about 21 degrees with respect to the Y axis 712. At the first ending point 855, the third section 2114 has a second angle 2114B of about 21 degrees with respect to the Y axis 712. The outer surface 2148 has an outer surface angle 2114C of about 11.67 degrees with respect to the Y axis 712. In some embodiments, the first angle 2114A and the second angle 2114B can be greater than the outer surface angle 2114C by about 10 degrees.

With regard to the first angle 2114A and the second angle 2114B, any suitable angle can be utilized. For example, the first angle 2114A and/or the second angle 2114B can be greater than about 0.5 degrees, greater than about 1 degree, greater than about 5 degrees, greater than about 10 degrees, greater than about 15 degrees, greater than about 20 degrees, greater than about 25 degrees, greater than about 30 degrees, greater than about 35 degrees, greater than about 40 degrees, greater than about 45 degrees, and/or less than about 45 degrees, less than about 40 degrees, less than about 30 degrees, less than about 25 degrees, less than about 20 degrees, less than about 15 degrees, less than about 10 degrees, less than about 5 degrees, less than about 1 degrees, or any individual number or any range that is within values provided above.

Similarly, with regard to the outer surface angle 2114C, any suitable angle can be utilized. As an example, the midpoint angle 2114C can be greater than about 0.5 degrees, greater than about 1 degree, greater than about 5 degrees, greater than about 10 degrees, greater than about 15 degrees, greater than about 20 degrees, greater than about 25 degrees, greater than about 30 degrees, and/or less than about 30 degrees, less than about 25 degrees, less than about 20 degrees, less than about 15 degrees, less than about 10 degrees, less than about 5 degrees, less than about 1 degree, and/or any individual number or any range that is within the values provided above.

As shown in FIGS. 7C and 7D, the first angle 2114A and the second angle 2114B can be inclined inward from the Y axis 712 toward an XZ plane 715, e.g. from the first starting point 854 to a second starting point 858 and from the first ending point 855 to a second ending point 859, respectively. Similarly, with regard to the outer surface angle 2114C, the third section 2114 can be inclined from the Y axis 712 toward the XZ plane 715. As shown, the widths of the third section 2114 generally decrease as the third section 2114 progresses along the Y axis 712.

The radius of curvature 2170 of the outer surface 2148 can vary with the variables $X_d$, $Y_d$, and $Z_d$. In the present invention, radius of curvature 2170 can be any suitable value. In some embodiments, the radius of curvature 2170 can be about describe as an function R(x), by an arc with a defined radius with an angle at the starting and endpoints, by multiple arcs or radii which are connected tangential to each other. In some embodiment, the radius 2170 may be between about 2 mm to about 15 mm. In some embodiments, the radius 2170 may be between about 6 mm to about 7 mm. In some embodiments, the radius 2170 may be about 6.6 mm. Also, embodiments, are contemplated where a plurality of arc like segments are joined tangentially wherein the plurality of arc segments comprise a plurality of radii.

Figure 8A:
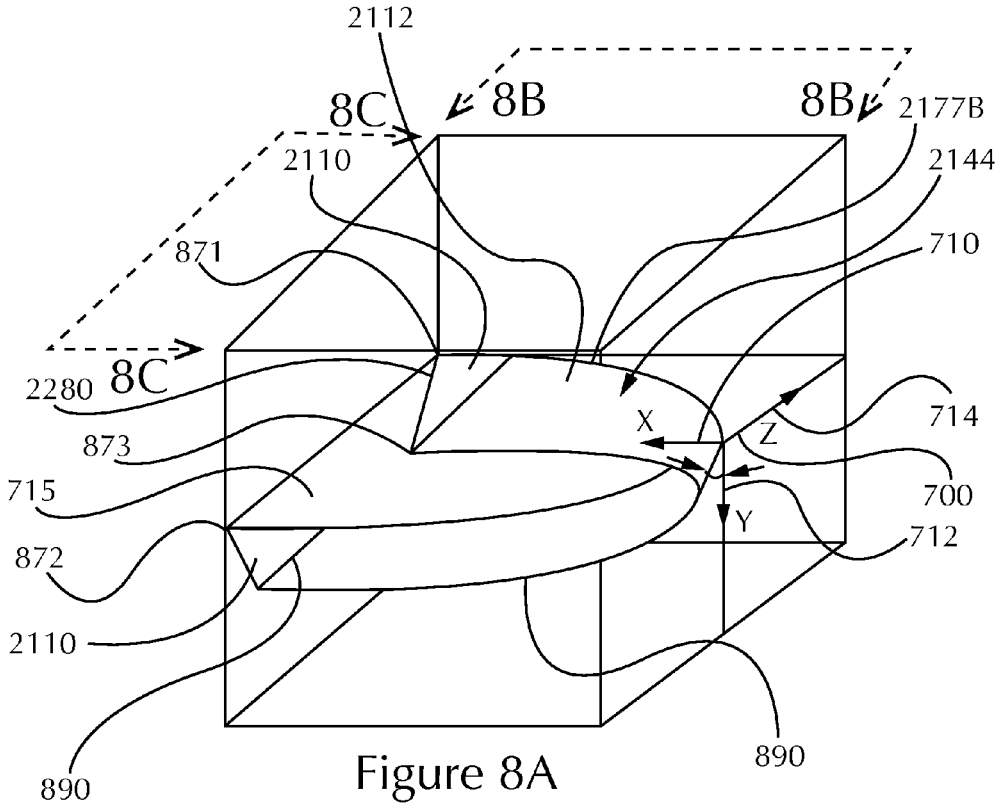
FIGS. 8A, 8B, and 8C, are partial perspective views showing a first and a second section of the intermediate area of the toothbrush of FIG. 1 with all other features of the toothbrush removed for clarity.
Figure 8B:
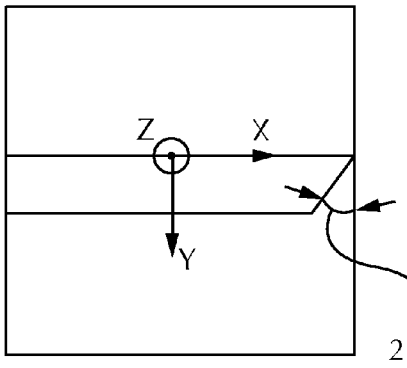
Figure 8C:
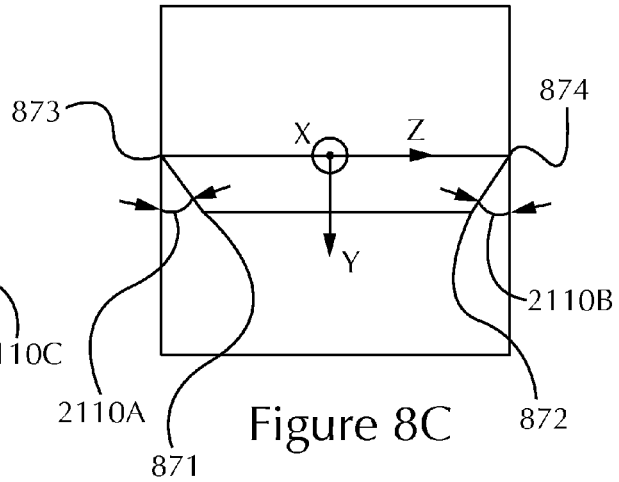

Referring to FIGS. 8A-8C, design of the second section 2112 and the first section 2110 in order to achieve the mold removal direction 1852 is discussed below. The first section 2110 has a first section starting point 871 with an edge which extends to a second starting point 873 along the mold part line 2280. The separation between the first section 2110 and the second section 2112 is reference line 890. The second section 2112 has comprises the intermediate surface 2144. The second section 2112 and the first section 2110 are bounded, in part, by the second boundary 2177B. As shown, the widths of the first section 2110 and the second section 2112 generally decrease as the first section 2110 and the second section 2112 progresses along the Y axis 712.

At the first starting point 871, the first section 2110 has a first angle 2110A of about 1.5 degrees with respect to the Z axis 714. At a first ending point 872, the first section 2110 has a second angle 2110B of about 1.5 degrees with respect to the Z axis 714. The intermediate surface 2144 has an intermediate surface angle 2110C of about 60 degrees with respect to the Y axis 712. In some embodiments, the first angle 2110A and the second angle 2110B can be less than the intermediate surface angle 2110C by greater than about 55 degrees.

With regard to the first angle 2110A and the second angle 2110B, any suitable angle can be utilized. For example, the first angle 2110A and/or the second angle 2110B can be greater than about 0.5 degrees, greater than about 1 degree, greater than about 5 degrees, greater than about 10 degrees, greater than about 15 degrees, greater than about 20 degrees, greater than about 25 degrees, greater than about 30 degrees, greater than about 35 degrees, greater than about 40 degrees, greater than about 45 degrees, and/or less than about 45 degrees, less than about 40 degrees, less than about 30 degrees, less than about 25 degrees, less than about 20 degrees, less than about 15 degrees, less than about 10 degrees, less than about 5 degrees, less than about 1 degrees, or any number or any range that is within values provided above.

Similarly, with regard to the intermediate surface angle 2110C, any suitable angle can be utilized. As an example, the intermediate surface angle 2110C can be greater than about 0.5 degrees, greater than about 1 degree, greater than about 5 degrees, greater than about 10 degrees, greater than about 15 degrees, greater than about 20 degrees, greater than about 25 degrees, greater than about 30 degrees, greater than about 40 degrees, greater than about 50 degrees, greater than about 60 degrees, greater than about 70 degrees, greater than about 80 degrees, greater than about 89 degrees, and/or less than about 90 degrees, less than about 80 degrees, less than about 70 degrees, less than about 60 degrees, less than about 50 degrees, less than about 40 degrees, less than about 30 degrees, less than about 25 degrees, less than about 20 degrees, less than about 15 degrees, less than about 10 degrees, less than about 5 degrees, less than about 1 degree, and/or any individual number or any range that is within the values provided above. The maximum intermediate surface angle 2110C should not exceed 89.5 degrees in some embodiments.

As shown in FIGS. 8B and 8C, the first angle 2110A and the second angle 2110B can be inclined inward from the Y axis 712 toward an XZ plane 715, e.g. from the first starting point 871 to a second starting point 873 and from the first ending point 872 to a second ending point 874, respectively. Similarly, with regard to the intermediate surface angle 2110C, the second section 2112 can be inclined from the Y axis 712 toward the XZ plane 715.

Similar to the third section 2114 (shown in FIGS. 7A-7D), the first section 2110 and/or second section 2112 may have a radius of curvature intermediate surface 2144 which can vary with the variables $X_d$, $Y_d$, and $Z_d$. In the present invention, radius of curvature for the first section 2110 and/or the second section 2112 can be configured similarly to the radius 2170 described heretofore.

Figure 9A:
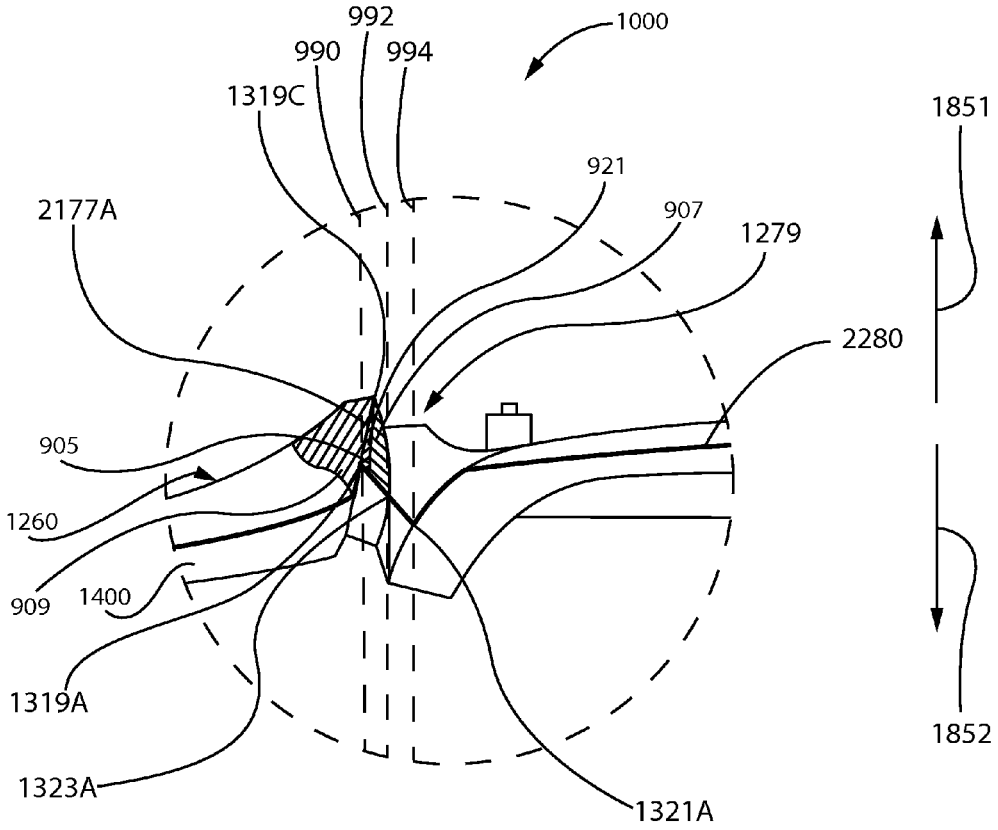
FIG. 9A is a close up side view of the base of FIG. 2A.

With regard to the first mold removal direction 1851, similar design strategies may be implemented to those described above. For example, as shown in FIG. 9A, proper design of a fourth section 905, a fifth section 907, and a sixth section 909, can help reduce the likelihood of undercuts. The fourth section 905 is defined by the first boundary 2177A and an intermediate boundary 921 which is parallel to the transverse axis 42 (shown in FIG. 2A) and extends from an upper first boundary point 1319C to the mold parting line 2280. The fourth section 905 is a likely candidate for an undercut if the toothbrush 1000 is not properly constructed.

The fifth section 907 is defined by the recess 1279 (the thinnest portion thereof with respect to the lateral axis 41 shown in FIG. 1A), the intermediate boundary 921, and the mold parting line 2280. The sixth section 909 is a portion of a neck 1400 of a toothbrush 1000 of the present invention. The sixth section 909 is defined by the first boundary 2177A, a top surface 1260 of the toothbrush 1000, and the mold parting line 2280.

A first reference line 990 indicates the path of travel for a mold portion forming the width associated with an intermediate first boundary point 1319A. A second reference line 992 indicates the path of travel for the mold portion forming the width associated with a primary intermediate area point 1323A. A third reference line 994 indicates the path of travel for the mold portion forming the width associated with the intermediate second boundary 1321A.

Figure 9B:
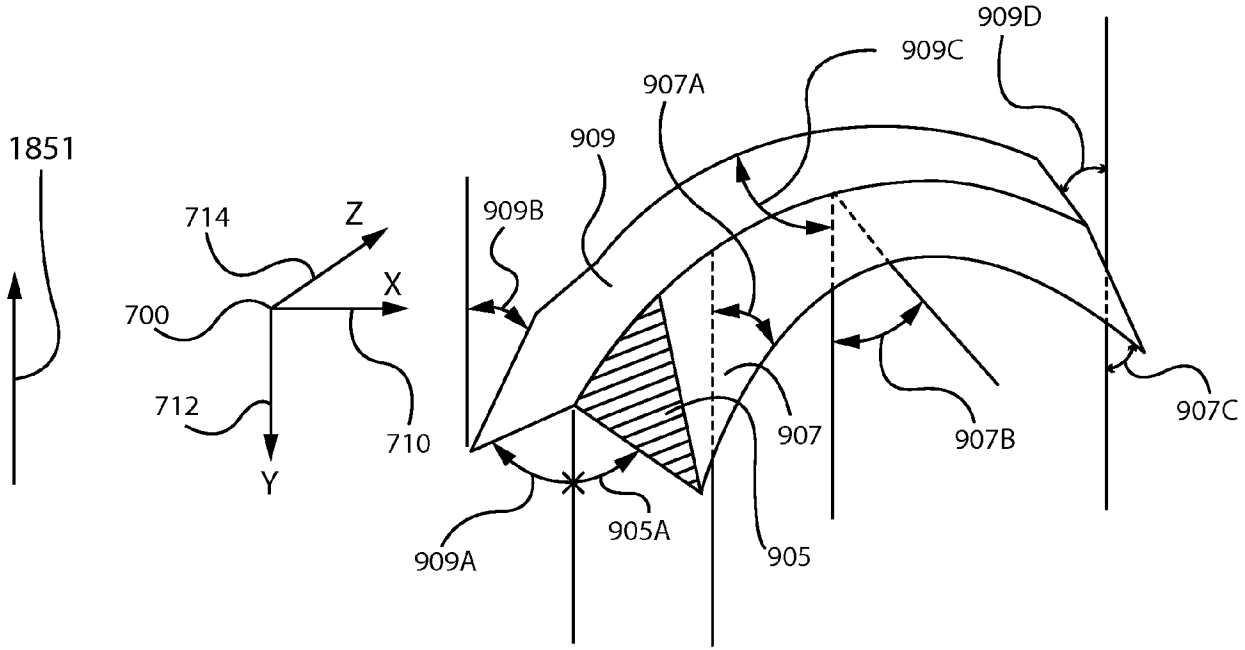
FIG. 9B is a partial perspective view showing a fourth, fifth, and sixth section, of the intermediate area of the toothbrush of FIG. 1.

Referring to FIG. 9B, the fourth section 905 can have a primary angle 905A from the Y axis 712 to the X axis 710 of about 45 degrees. The primary angle 905A can be any suitable number. For example, in some embodiment, the primary angle 905A can be greater than about 3 degrees, greater than about 10 degrees, greater than about 20 degrees, greater than about 30 degrees, greater than about 40 degrees, greater than about 50 degrees, greater than about 60 degrees, greater than about 70 degrees, greater than about 80 degrees, and/or less than about 90 degrees, less than about 80 degrees, less than about 70 degrees, less than about 60 degrees, less than about 50 degrees, less than about 40 degrees, less than about 30 degrees, less than about 20 degrees, less than about 10 degrees, less than about 5 degrees, or any number or any range within the values provided above.

The fifth section 907 can have a primary angle 907A, a secondary angle 907B, and a tertiary angle 907C. Similarly, the sixth section 909 can have a primary angle 909A, a secondary angle 909B, a tertiary angle 909C, and a quaternary angle 909D.

The primary angle 907A and tertiary angle 907C, in some embodiments, may comprise the same measure, e.g. about 11 degrees from the Y axis 712 to the Z axis 714. However, both the primary angle 907A and the tertiary angle 907C may comprise any suitable value. For example, these angles may have a measure which is greater than about 0.5 degrees, greater than about1.0 degrees, greater than about 1.5 degrees, greater than about 5 degrees, greater than about 10 degrees, greater than about 15 degrees, greater than about 20 degrees, greater than about 25 degrees, greater than about 30 degrees, and/or less than about 35 degrees, less than about 30 degrees, less than about 25 degrees, less than about 20 degrees, less than about 15 degrees, less than about 10 degrees, less than about 5 degrees, less than about 1.5 degrees, less than about 1 degree, or any number or any range within the values provided above.

The secondary angle 907B can be about 70 degrees from the Y axis 712 to the Z axis 714; however, any suitable value can be utilized. In some embodiments, the secondary angle 907B can have a measure of greater than about 45, greater than about 55 greater than about 65 degrees, greater than about 75 degrees, greater than about 85 degrees, and/or less than about 90 degrees, less than about 85 degrees, less than about 75 degrees, less than about 65 degrees, less than about 55 degrees, or any number or any range within the values provided above.

The primary angle 909A can be about 80 degrees from the Y axis 712 to the X axis 710. In some embodiments, the primary angle 909A can be greater than about 3 degrees, greater than about 10 degrees, greater than about 20 degrees, greater than about 30 degrees, greater than about 40 degrees, greater than about 50 degrees, greater than about 60 degrees, greater than about 70 degrees, greater than about 80 degrees, and/or less than about 90 degrees, less than about 80 degrees, less than about 70 degrees, less than about 60 degrees, less than about 50 degrees, less than about 40 degrees, less than about 30 degrees, less than about 20 degrees, less than about 10 degrees, less than about 5 degrees, or any number or any range within the values provided above.

The secondary angle 909B and the quaternary angle 909D can have the same value, e.g. about 16 degrees, from the Y axis 712 to the Z-axis 714, in some embodiments. In some embodiments, the secondary angle 909B and the fourth angle 909D can be greater than about 0.5 degrees, greater than about 1.0 degrees, greater than about 1.5 degrees, greater than about 5 degrees, greater than about 10 degrees, greater than about 15 degrees, greater than about 20 degrees, greater than about 25 degrees, greater than about 30 degrees, greater than about 35 degrees, greater than about 40 degrees, and/or less than about 45 degrees, less than about 40 degrees, less than about 35 degrees, less than about 30 degrees, less than about 25 degrees, less than about 20 degrees, less than about 15 degrees, less than about 10 degrees, less than about 5 degrees, less than about 1.5 degrees, less than about 1 degree, or any number or any range within the values provided above.

The tertiary angle 909C can be about 41 degrees from the Y axis 712 to the Z axis 714, in some embodiments. In some embodiments, the tertiary angle 909C may have a value which is greater than about 3 degrees, greater than about 10 degrees, greater than about 20 degrees, greater than about 30 degrees, greater than about 40 degrees, greater than about 50 degrees, greater than about 60 degrees, greater than about 70 degrees, greater than about 80 degrees, and/or less than about 90 degrees, less than about 80 degrees, less than about 70 degrees, less than about 60 degrees, less than about 50 degrees, less than about 40 degrees, less than about 30 degrees, less than about 20 degrees, less than about 10 degrees, less than about 5 degrees, or any number or any range within the values provided above.

Aside from undercuts, another problem which can occur is burring. A bur occurs when a thin film is created near a mold part edge. Referring back to FIGS. 2B, 3A, and 5B, near the mold parting line 280 in the intermediate region 279, mold parts may require seating portions in order to reduce the likelihood of leakage beyond one mold portion into the area between the mold portions. As such, as shown in FIG. 3A, flat seating portions 311A and 311B are provided on either side of the body 210 for a lower mold cavity. These flat seating portions 311A and 311B can reduce the likelihood of burring. Similarly, as shown in FIG. 5A, flat seating portions 313A and 313B can be provided on either side of the body 210 for an upper mold cavity. These flat seating portions 313A and 313B can reduce the likelihood of burring.

Any suitable materials may be utilized for the oral care implement described herein. For example, the base 210 (shown in FIGS. 1B, 2A-2B, 3A-3C, 4A-4C, and 5A-5B) may comprise polyethylene (PE), polypropylene (PP), polyethyleneterapthalate (PET), acrylonitrile-butadiene-styrene (ABS), styrene-acrylonitrile (SAN), PP and thermoplastic elastomer (TPE) blends, acetal (POM), nylon (PA), modified polyphenylene oxid (PPO), polyester (PBT), polycarbonate (PC), high impact polystyrene (HIPS), isoplast and other thermoplastic urethane (TPU) materials, the like, and suitable combinations thereof The first grip member 20, the second grip member, the collar 290, the strip of material, the tongue cleaner, and/or the elastomeric elements may comprise any suitable thermoplastic elastomer. Some suitable examples include SEBS (styrene-ethylene-butylene-styrene block copolymer) or thermoplastic polyurethane. In some embodiments, the material utilized in the first grip member 20, the second grip member, the collar 290, the strip of material, the tongue cleaner, and/or the elastomeric elements, may be selected to provide a specific benefit for the user. For example, the material selected in the first grip member 20 may be softer than the material utilized in the plurality of elastomeric elements. In other examples, additives may be included in the material utilized for the first grip member 20, the second grip member, the collar 290, the strip of material, the tongue cleaner, and/or the elastomeric elements. In some embodiments, additives may be added to provide an aesthetic appeal to the material. As an example, glitter may be added to the material. In some embodiments, the material utilized for the first grip member 20 may be used for all portions of the toothbrush utilizing an elastomeric material.

Additionally, as used herein, the term "contact elements" is used to refer to any suitable element which can be inserted into the oral cavity. Some suitable elements include bristle tufts, elastomeric massage elements, elastomeric cleaning elements, massage elements, tongue cleaners, soft tissue cleaners, hard surface cleaners, combinations thereof, and the like. The head may comprise a variety of cleaning elements. For example, the head may comprise bristles, abrasive elastomeric elements, elastomeric elements in a particular orientation or arrangement, e.g. pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

In some embodiments, the contact elements 20 may comprise tufts. The tufts may comprise a plurality of individual filaments which are securely attached to a cleaning element carrier. Such filaments may be polymeric and may include polyamide or polyester. The longitudinal and cross sectional dimensions of the filaments of the invention and the profile of the filament ends can vary. Additionally, the stiffness, resiliency and shape of the filament end can vary. Some examples of suitable dimensions include a length between about 3 cm to about 6 cm, or any individual number within the range. Additionally, the filaments may include a substantially uniform cross-sectional dimension of between about 100 to about 350 microns, or any individual number within the range. The tips of the filaments may be any suitable shape, examples of which include a smooth tip, a rounded tip, a pointed tip (tapered), and/or flagged tip. Additionally, embodiments are contemplated where a single tuft includes a combination of different tufts, e.g. tapered and rounded, tapered and flagged, etc. In some embodiments, the filaments may include a dye which indicates wear of the filaments as described in U.S. Pat. No. 4,802,255. Some examples of suitable filaments for use with the brush of the present invention are described in U.S. Pat. No. 6,199,242. In some embodiments, the cleaning elements may comprise fins as described heretofore. For example, in some embodiments, the cleaning element fields may comprise a combination of fins and tufts.

The contact elements may be attached to the head in any suitable manner. Conventional methods include stapling, anchor free tufting, and injection mold tufting. For those cleaning elements that comprise an elastomer, these elements may be formed integral with one another, e.g. having an integral base portion and extending outward therefrom.

In some embodiments, the oral care implement 10 may comprise a tongue cleaner. The tongue cleaner may be disposed in a recess on a back side of the head 16. The tongue cleaner may comprise a plurality of tongue cleaning structures which may be utilized to reduce and the amount of odor causing substances in the oral cavity. Some examples of suitable materials for the tongue cleaner include elastomeric materials; polypropylene, polyethylene, etc; the like, and/or combinations thereof The tongue cleaner may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

The present invention may be utilized in manual toothbrushes where the cleaning motion is supplied completely by a user. However, embodiments are contemplated where the present invention comprises a manual toothbrush which supplements the user's motions with a vibration device as described in U.S. Patent Application Publication No. 2003/0162145. Moreover, embodiments are contemplated where the present invention includes a power toothbrush. A power toothbrush is one where the toothbrush provides the majority of the cleaning motion. The user may manipulate the power toothbrush to ensure that the power toothbrush contacts the desired oral surfaces. In such embodiments, the contact elements may be driven in a variety of motions. Some examples of such suitable motions are described in U.S. Patent Application Publication No. 2003/0084527. Also, embodiments are contemplated where the present invention includes a replaceable brush head for a power and/or a manual toothbrush.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral care implement comprising:

a base having a handle region, an oral engaging region, a neck between the handle region and the oral engaging region, the base further comprising a recess surrounding the handle and/or the neck and having a first boundary and a second boundary, the first boundary being more distant from a distal end than the second boundary, the first boundary and the second boundary being angled with respect to a mold parting line of the oral care implement, the recess further including an intermediate area disposed between the first boundary and the second boundary, the intermediate area having a differential width along a length of the intermediate area, the differential width including a primary intermediate width extending through a point where the mold parting line intersects a thinnest portion of the width of the intermediate area, the primary intermediate width being disposed intermediate the first boundary and the second boundary, wherein the base comprises a first material; and a collar comprising a second material disposed in the recess, and wherein the second material is softer than the first material.

2. The oral care implement of claim 1, wherein the second material is an elastomer.

3. The oral care implement of claim 1, wherein the second boundary is at an angle of greater than about 70 degrees with respect to the mold parting line.

4. The oral care implement of claim 1, wherein the recess surround the neck.

5. The oral care implement of claim 1, further comprising a first grip member forming at least a portion of the front side surface.

6. The oral care implement of claim 5, further comprising a guidance element disposed in an opening in the first grip member.

7. The oral care implement of claim 6, wherein the guidance element comprises the first material and the first grip member comprises the second material.

8. The oral care implement of claim 5, wherein the first grip member and the collar are unitary.

9. The oral care implement of claim 5, further comprising a second grip member positioned on a back side of the body.

10. The oral care implement of claim 9, wherein the body further comprises a plurality of apertures such that the first grip member and the second grip member are unitary.

11. The oral care implement of claim 10, wherein the first grip member, the second grip member, and the collar are unitary.

12. The oral care implement of claim 1, further comprising a tongue cleaner disposed on a back side of the oral engaging region.

13. The oral care implement of claim 12, further comprising a first grip member and a second grip member, the second grip member being disposed on a back side of the body.

14. The oral care implement of claim 12 further comprising a strip of material extending between the tongue cleaner and the second grip member and being unitarily formed therewith.

15. The oral care implement of claim 14, wherein the body further comprises a channel extending between the second grip member and the tongue cleaner, and wherein the strip of material is disposed in the channel.

16. The oral care implement of claim 15, wherein the first grip member, the second grip member, the strip of material, the tongue cleaner, and the collar are unitary.

17. The oral care implement of claim 1, wherein the second boundary is at an angle of greater than about 90 degrees with respect to the mold parting line.

* * * * *